US008556249B2

(12) United States Patent
Ando et al.

(10) Patent No.: US 8,556,249 B2
(45) Date of Patent: Oct. 15, 2013

(54) IMAGE FORMING APPARATUS THAT SUPPLIES SHEET ON WHICH IMAGE IS FORMED TO RING BOOKBINDING APPARATUS

(75) Inventors: Yutaka Ando, Toride (JP); Mitsuhiko Sato, Kashiwa (JP); Naoto Watanabe, Abiko (JP); Takayuki Fujii, Tokyo (JP); Yushi Oka, Abiko (JP); Toshiyuki Miyake, Abiko (JP); Takashi Yokoya, Kashiwa (JP); Hiromasa Maenishi, Matsudo (JP)

(73) Assignee: Canon Kabushiki Kaisha (JP)

( * ) Notice: Subject to any disclaimer, the term of this patent is extended or adjusted under 35 U.S.C. 154(b) by 236 days.

(21) Appl. No.: 13/233,199

(22) Filed: Sep. 15, 2011

(65) Prior Publication Data

US 2012/0070250 A1 Mar. 22, 2012

(30) Foreign Application Priority Data

Sep. 17, 2010 (JP) ..... 2010-209673

(51) Int. Cl.
*B65H 37/04* (2006.01)

(52) U.S. Cl.
USPC ..... 270/58.09; 270/58.08; 270/47

(58) Field of Classification Search
USPC ..... 270/58.09, 58.08, 58.07, 58.04, 38, 47; 399/408
See application file for complete search history.

(56) References Cited

U.S. PATENT DOCUMENTS

| | | | | |
|---|---|---|---|---|
| 6,070,023 | A * | 5/2000 | Kataoka | 399/45 |
| 6,860,478 | B2 * | 3/2005 | Hirai | 270/58.07 |
| 7,588,241 | B2 * | 9/2009 | Murata et al. | 270/58.11 |
| 8,346,155 | B2 * | 1/2013 | Iwata | 399/407 |
| 2003/0156872 | A1 * | 8/2003 | Hirai | 399/407 |

FOREIGN PATENT DOCUMENTS

| | | | |
|---|---|---|---|
| JP | 10279166 | A * | 10/1998 |
| JP | 2005-138549 | A | 6/2005 |

* cited by examiner

*Primary Examiner* — Patrick Mackey
(74) *Attorney, Agent, or Firm* — Rossi, Kimms & McDowell LLP

(57) ABSTRACT

An image forming apparatus that enables to execute a bookbinding process for sheet bundles without decreasing productivity. The image forming apparatus is connected to a bookbinding apparatus having a bookbinding unit that binds a book by attaching a ring to a punch hole and a buffer unit that performs a buffering process to convey sheets in piles so that sheets for a next sheet bundle are not ejected onto a sheet bundle that is being processed by the bookbinding unit. A determination unit determines whether a sheet is a type that is prohibited from buffering. A control unit adjusts an ejection order so that the sheet of the type that is prohibited from buffering is not ejected within the predetermined number of sheets from the first sheet of sheets that constitute the sheet bundle, when the determination unit determines that the sheet is the type that is prohibited from buffering.

6 Claims, 19 Drawing Sheets

IMAGE FORMING APPARATUS THAT SUPPLIES SHEET ON WHICH IMAGE IS FORMED TO RING BOOKBINDING APPARATUS

BACKGROUND OF THE INVENTION

1. Field of the Invention

The present invention relates to an image forming apparatus that supplies a sheet on which an image is formed to a ring bookbinding apparatus. Particularly, the present invention relates to a ring bookbinding technique for binding a book by threading rings through punch holes of sheets.

2. Description of the Related Art

Conventionally, a bind processing apparatus that aligns sheets to make a sheet bundle, attaches a ring type binding member to punch holes of the sheets by pushers, and ejects a bound booklet to a stack tray is proposed (for example, see Japanese Laid-Open Patent Publication (Kokai) No. 2005-138549 (JP 2005-138549A)).

When a plurality of booklets are made by such a ring bookbinding, a buffer device, which is located at the upstream side of a bookbinding unit, temporarily stores a plurality of sheets in order not to supply sheets for a next sheet bundle while the bookbinding unit is binding a previous sheet bundle. Then, when the bookbinding unit finishes the bookbinding process, the sheets stored in the buffer device are supplied to the bookbinding unit in piles. This enables to execute the bookbinding process without decreasing productivity.

However, since a plurality of sheets are conveyed in piles when the sheets are stored in the buffer device according to the above mentioned method, the sheets may stick mutually when the sheets are made from sticky material (OHP sheets, coated sheets, etc.). The mutual stick of the sheets causes misalignment of the sheet bundle, which causes a fault in a subsequent bookbinding process. Therefore, a sheet made from such material is prohibited to be buffered.

In particular, when an OHP sheet or a coated sheet is used for the first page (for example, a cover or a back cover) of a sheet bundle to be bound, sheets for a next sheet bundle cannot be printed and stored into the buffer device while binding a previous sheet bundle. Therefore, the conveyance interval of sheets must be extended, which decreases productivity.

SUMMARY OF THE INVENTION

The present invention provides a technique that enables to execute a bookbinding process for a plurality of sheet bundles without decreasing productivity even when an OHP sheet or a coated sheet is used for a first page of a sheet bundle to be bound.

Accordingly, a first aspect of the present invention provides an image forming apparatus that is connected to a bookbinding apparatus having a bookbinding unit that binds a book by attaching a ring to a punch hole of a sheet bundle and a buffer unit that performs a buffering process to convey a predetermined number of sheets in piles so that sheets for a next sheet bundle are not ejected onto a sheet bundle that is being processed by the bookbinding unit, the image forming apparatus comprising a determination unit configured to determine whether a sheet is a type that is prohibited from performing the buffering process by the buffer unit, and a control unit configured to adjust an ejection order so that the sheet of the type that is prohibited from performing the buffering process is not ejected within the predetermined number of sheets from the first sheet of sheets that constitute the sheet bundle, when the determination unit determines that the sheet is the type that is prohibited from performing the buffering process.

Accordingly, a second aspect of the present invention provides an image forming system comprising an image forming unit configured to form an image onto a sheet, a bookbinding unit configured to bind a book by attaching a ring to a punch hole of a sheet bundle that consists of a plurality of sheets on which images are formed, a buffer unit configured to perform a buffering process to convey a predetermined number of sheets in piles so that sheets for a next sheet bundle are not ejected onto a sheet bundle that is being processed by the bookbinding unit, a determination unit configured to determine whether a sheet is a type that is prohibited from performing the buffering process by the buffer unit, and a control unit configured to adjust an ejection order so that the sheet of the type that is prohibited from performing the buffering process is not ejected within the predetermined number of sheets from the first sheet of sheets that constitute the sheet bundle, when the determination unit determines that the sheet is the type that is prohibited from performing the buffering process.

Accordingly, a third aspect of the present invention provides a control method for an image forming apparatus that is connected to a bookbinding apparatus having a bookbinding unit that binds a book by attaching a ring to a punch hole of a sheet bundle and a buffer unit that performs a buffering process to convey a predetermined number of sheets in piles so that sheets for a next sheet bundle are not ejected onto a sheet bundle that is being processed by the bookbinding unit, the control method comprising a determination step of determining whether a sheet is a type that is prohibited from performing the buffering process by the buffer unit, and a control step of adjusting an ejection order so that the sheet of the type that is prohibited from performing the buffering process is not ejected within the predetermined number of sheets from the first sheet of sheets that constitute the sheet bundle, when it is determines that the sheet is the type that is prohibited from performing the buffering process in the determination step.

Accordingly, a fourth aspect of the present invention provides a control method for an image forming system comprising an image forming step of forming an image onto a sheet, a bookbinding step of binding a book by attaching a ring to a punch hole of a sheet bundle that consists of a plurality of sheets on which images are formed, a buffering step of performing a buffering process to convey a predetermined number of sheets in piles so that sheets for a next sheet bundle are not ejected onto a sheet bundle that is being processed in the bookbinding step, a determination step of determining whether a sheet is a type that is prohibited from performing the buffering process in the buffering step, and a control step of adjusting an ejection order so that the sheet of the type that is prohibited from performing the buffering process is not ejected within the predetermined number of sheets from the first sheet of sheets that constitute the sheet bundle, when it is determines that the sheet is the that is prohibited from performing the buffering process in the determination step.

According to the present invention, the bookbinding process for a plurality of sheet bundles can be executed without decreasing productivity even when an OHP sheet or a coated sheet is used for a first page of a sheet bundle to be bound.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
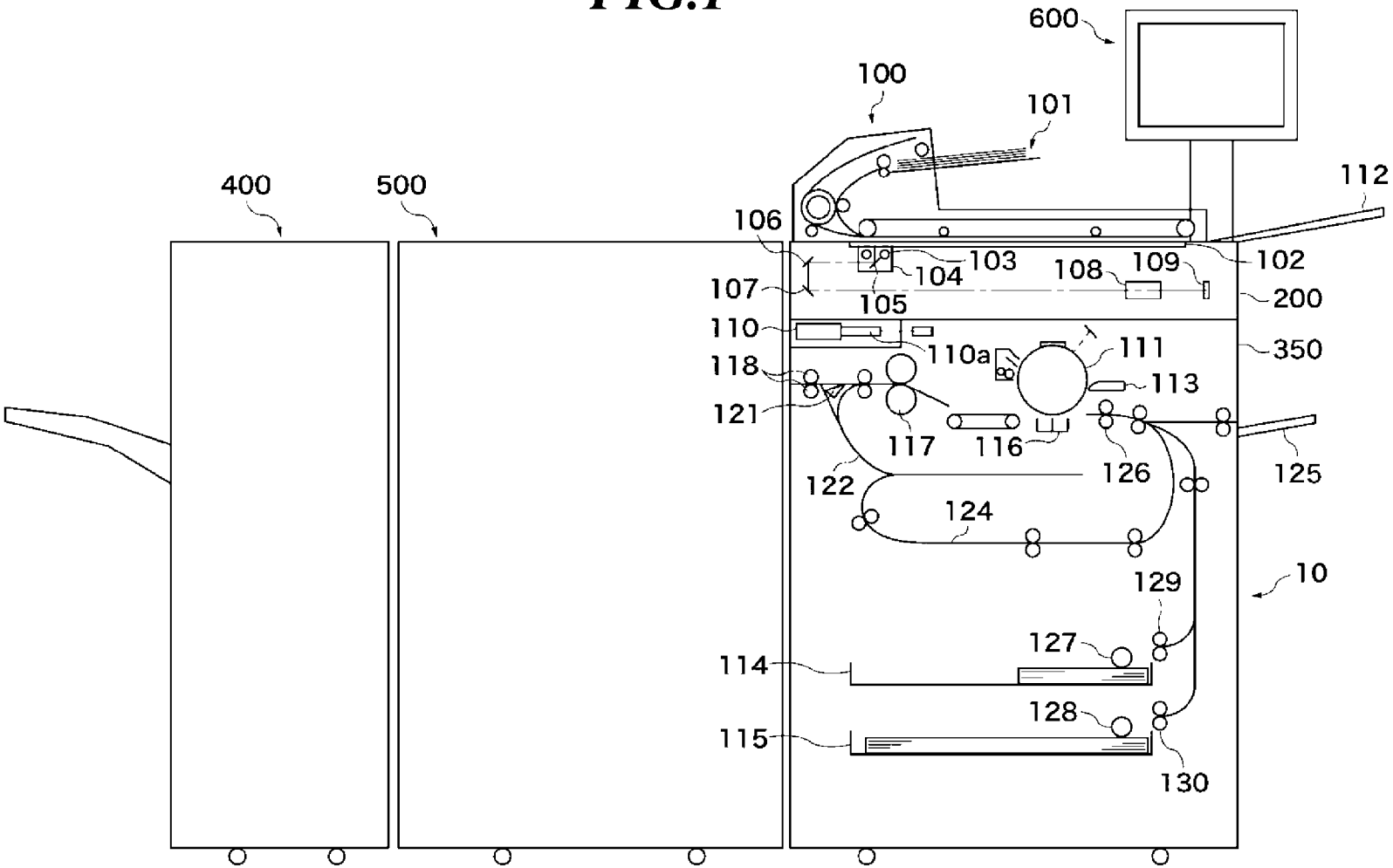
FIG. 1 is a view showing a configuration example of an image forming system including an image forming apparatus according to a first embodiment of the present invention.

FIG. 1 is a view showing a configuration example of an image forming system including an image forming apparatus according to a first embodiment of the present invention.

The image forming system in this embodiment comprises the image forming apparatus 10, a ring bookbinding apparatus 500 connected to the latter side of the image forming apparatus 10, and a finisher 400, for example. The ring bookbinding apparatus 500 is a post-processing device that binds a book by attaching rings to punch holes of a sheet bundle. The finisher 400 is a post-processing device that performs post-processes such as stapling and sorting.

The image forming apparatus 10 is provided with an image reader 200 that reads an image of an original, and a printer 350 that forms the read image onto a sheet. An original feeding device 100 feeds originals set upward on an original tray 101 one by one from the first page leftward in the drawing, and conveys the original through a curved path from the left side to the right side on a platen glass 102 through a predetermined moving-original reading position. Then, the original is ejected to an external sheet ejection tray 112. The moving-original reading position is a predetermined read position on the platen glass with which the image reader 200 is equipped, and a scanner unit 104 is fixed at that position.

When an original passes the moving-original reading position on the platen glass 102 from the left side to the right side, an original image is read by the scanner unit 104 held in the position corresponding to the moving-original reading position. When an original passes the moving-original reading position, a reading surface of the original is irradiated with light from a lamp 103 in the scanner unit 104, and the reflected light from the original is guided to the lens 108 via mirrors 105, 106, and 107. The light passed through the lens 108 forms an image on an imaging surface of an image sensor 109.

The image read optically by the image sensor 109 is converted into image data and is outputted. The image data outputted from the image sensor 109 is inputted into an exposure unit 110 in the printer 350 as a video signal.

Thus, the original is scanned by conveying the original so as to pass the moving-original reading position from the left side to the right side. Here, a direction that intersects perpendicularly to the conveyance direction of the original is a principal scanning direction and the conveyance direction is an auxiliary scanning direction. That is, the entire image of the original is read by conveying the original in the auxiliary scanning direction while reading the original image line by line in the principal scanning direction by the image sensor 109 when the original passes the moving-original reading position.

The image forming apparatus 10 is also possible to read an original by conveying the original onto the platen glass 102 by the original feeding device 100 and stopping the original at a predetermined position, and by scanning the scanner unit 104 from the left side to the right side. This method of reading is called a fixed original reading.

When an original is read without using the original feeding device 100, a user lifts up the original feeding device 100 and sets the original on the platen glass 102, then scans the scanner unit 104 from the left side to the right side to read the original. That is, when reading an original without using the original feeding device 100, the fixed original reading is performed.

The exposure unit 110 in the printer 350 modulates and outputs a laser beam based on the video signal inputted from the image reader 200. The laser beam concerned is scanned by a polygon mirror 110*a* and is irradiated on a photosensitive drum 111. An electrostatic latent image according to the scanned laser beam is formed on the photosensitive drum 111. The exposure unit 110 outputs the laser beam so that an erect image (not reversed) is formed at the time of the fixed original reading. The electrostatic latent image on the photosensitive drum 111 is developed as a visible toner image by toner supplied from a development device 113.

On the other hand, a sheet supplied from an upper cassette 114 or a lower cassette 115 equipped in the printer 350 by a pickup roller 127 or 128 is conveyed to a registration roller pair 126 by a feed roller pair 129 or 130. When the front edge of the sheet arrives at the registration roller pair 126, the registration roller pair 126 is driven with arbitrary timing so that the sheet is conveyed to a position between the photosensitive drum 111 and a transfer unit 116 with timing synchronized with a start of the irradiation of the laser beam.

The toner image formed on the photosensitive drum 111 is transferred by the transfer unit 116 onto the supplied sheet. The sheet on which the toner image has been transferred is conveyed by a fixing unit 117. The fixing unit 117 fixes the toner image on the sheet by heating and pressurizing the sheet. The sheet passed through the fixing unit 117 is ejected from the printer 350 to the outside of the apparatus, i.e., to the ring bookbinding apparatus 500 via a flapper 121 and an ejection roller pair 118.

When the sheet is ejected with the image formation side down (face-down), the sheet passed through the fixing unit 117 is once guided in an inversion path 122 by a switching operation of the flapper 121. Then, after the rear edge of the sheet passes the flapper 121, the sheet is moved back and is ejected from the printer 350 by the ejection roller pair 118. This ejection mode is called an inverted ejection. The inverted ejection is performed when forming images sequentially from the first page, for example, when forming images read by using the original feeding device 100 or when forming images outputted from a computer. The inverted ejection results in a correct sheet order after the ejection.

A hard sheet like an OHP sheet is fed from a manual sheet feeder 125. When an image is formed on a hard sheet, the sheet is ejected with the image formation side up (face-up) by the ejection roller pair 118 without guiding the sheet to the inversion path.

When a double-side printing, which forms images on both sides of a sheet, is set, the sheet is guided to the inversion path 122 by the switching operation of the flapper 121, and then, the sheet is conveyed to a double-sided conveyance path 124. Then, the image forming apparatus 10 is controlled so that the sheet guided to the double-sided conveyance path 124 is fed to the position between the photosensitive drum 111 and the transfer unit 116 again with the above-mentioned timing. The sheet ejected from the printer 350 of the image forming apparatus 10 is sent to the ring bookbinding apparatus 500.

An operation display unit 600 of the image forming apparatus 10 has a plurality of keys for setting various functions about image formation, a display unit for displaying information showing set state, etc.

Next, the control system of the entire image forming system in FIG. 1 will be described with reference to FIG. 2.

Figure 2:
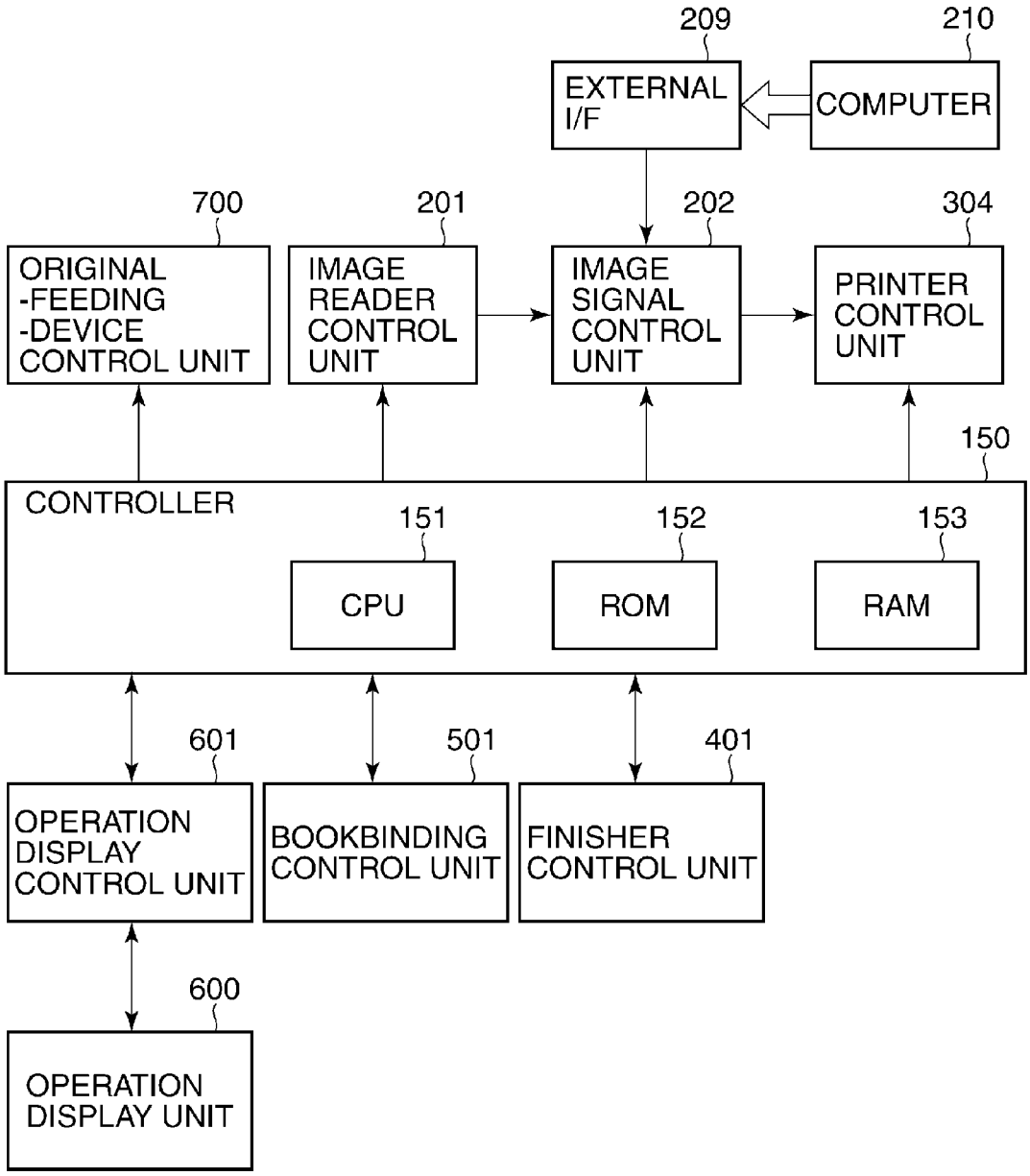
FIG. 2 is a block diagram schematically showing a control system for the entire image forming system in FIG. 1.

FIG. 2 is a block diagram schematically showing the control system for the entire image forming system in FIG. 1. It should be noted that elements shown in FIG. 2 include hardware modules and software modules.

A controller 150 is arranged inside the image forming apparatus 10 to control the image forming apparatus 10, and the ring bookbinding apparatus 500 and the finisher 400 that are connected to the apparatus 10. The controller 150 includes a CPU 151, a ROM 152, and a RAM 153.

The CPU 151 basically controls the entire image forming system. The ROM 152 that stores control programs and the RAM 153 for processing are connected to the CPU 151 via an address bus and a data bus (not shown). The CPU 151 integrally controls blocks (700, 201, 202, 209, 304, 401, 501, and 601) mentioned later according to the control programs stored in the ROM 152. The RAM 153 temporarily holds control data and is used as a working area for data processing accompanying the control.

The original-feeding-device control unit 700 controls to drive the original feeding device 100 based on instructions from the controller 150. The image reader control unit 201 controls to drive the above-mentioned scanner unit 104, the image sensor 109, etc., and transmits an analog image signal outputted from the image sensor 109 to an image signal control unit 202.

The image signal control unit 202 converts the analog image signal from the image sensor 109 into a digital signal, applies processes to the digital signal, converts the processed digital signal into a video signal, and outputs the video signal to a printer control unit 304. The image signal control unit 202 applies various processes to the digital image signal inputted from the external computer 210 via an external I/F 209, converts the digital image signal into a video signal, and outputs the video signal to the printer control unit 304. The processing operation by the image signal control unit 202 is controlled by the controller 150. The printer control module 304 controls the above-mentioned exposure unit 110 based on the inputted video signal.

A finisher control unit 401 is mounted in the finisher 400, and integrally controls sections of the finisher based on signals from the controller 150. A bookbinding control unit 501 is mounted in the ring bookbinding apparatus 500, and controls to drive the entire bookbinding apparatus based on signals from the controller 150. Details of the bookbinding control unit 501 are mentioned later.

An operation display control unit 601 exchanges information between the operation display unit 600 and the controller 150. The operation display unit 600 outputs a key signal corresponding to a key operation to the controller 150, and displays corresponding information based on the signal from the controller 150 on the display unit.

Next, the ring bookbinding apparatus 500 in FIG. 1 is described with reference to FIG. 3 and FIG. 4.

Figure 3:
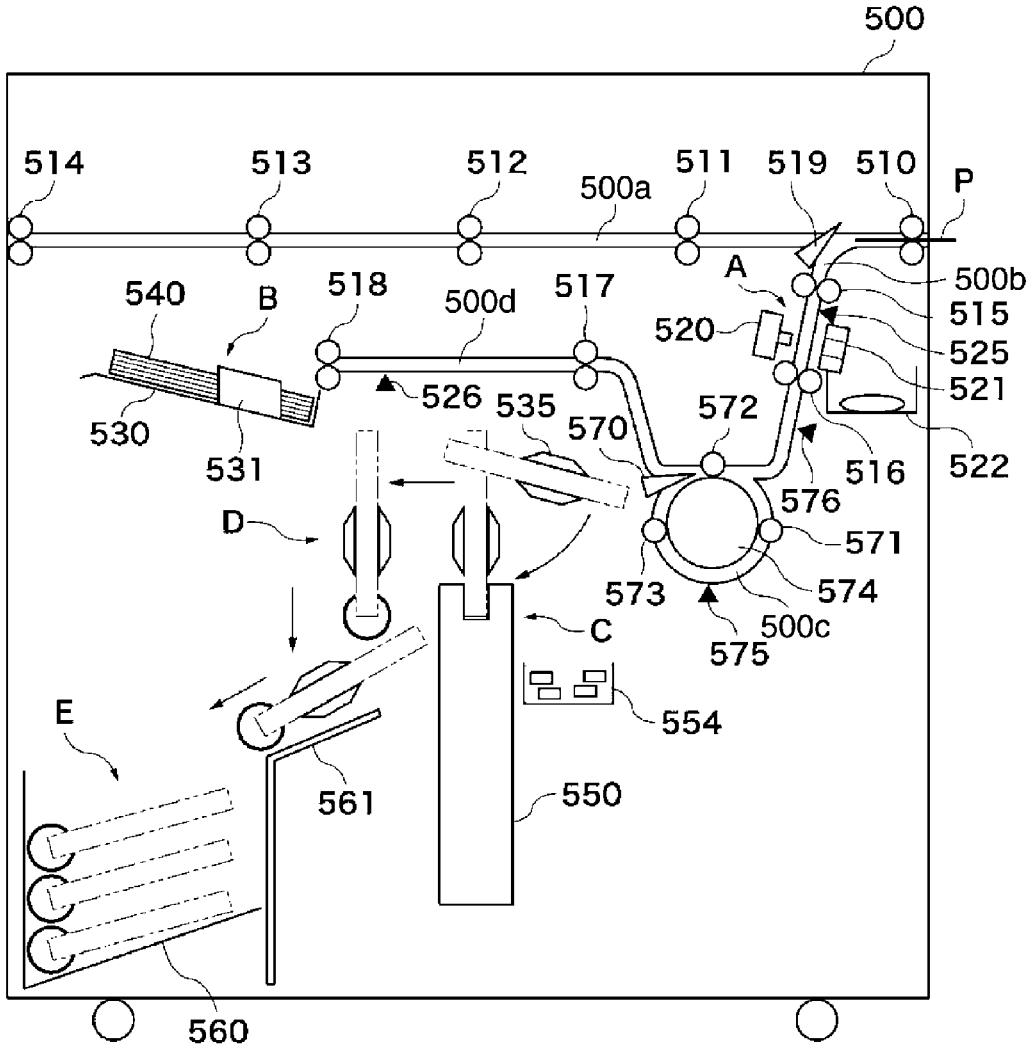
FIG. 3 is a longitudinal sectional view schematically showing a configuration of a ring bookbinding apparatus shown in FIG. 1.
Figure 4:
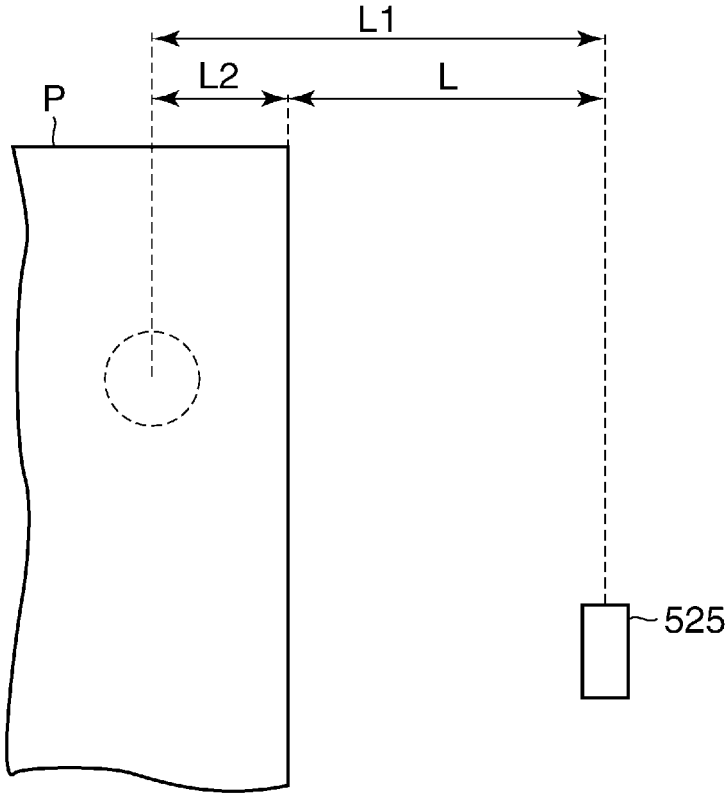
FIG. 4 is a view showing the positional relationship between a punch position of a sheet and a punch rear edge detection sensor in the ring bookbinding apparatus in FIG. 3.

FIG. 3 is a longitudinal sectional view schematically showing a configuration of the ring bookbinding apparatus 500 shown in FIG. 1.

When the sheet P is ejected from the image forming apparatus 10, the ring bookbinding apparatus 500 receives the sheet P thereinto by a conveying roller pair 510. When the received sheet P should be conveyed to the finisher 400, a flapper 519 is switched by driving a solenoid (not shown) so that the sheet P is guided to a conveyance path 500*a*. The sheet guided to the conveyance path 500*a* is conveyed downstream by conveying roller pairs 511, 512, 513, and 514, and is ejected to the finisher 400.

On the other hand, when the received sheet P is a target of a bookbinding process, the flapper 519 is switched so that the sheet is guided to the conveyance path 500*b*. First, a sheet punching unit A applies a punching process to the sheet P guided to the conveyance path 500*b*. The sheet P pinched by a conveying roller pair 515 is conveyed downstream, and is further pinched and conveyed by a conveying roller pair 516. Then, when a punch rear edge detection sensor 525 detects the rear edge of the sheet P, the drive of the conveying roller pair 516 will be stopped after conveying the sheet P in a prescribed distance L. The prescribed distance L is equal to the difference between the fixed distance L1 from the center of the punch rear edge detection sensor 525 to the center position of a punching unit 520 and the variable distance L2 from the rear edge of the sheet P to the center position of the hole formed by the punching process, as shown in FIG. 4.

After the sheet P stops at the position conveyed by the prescribed distance L from the center position of the punch rear edge detection sensor 525, the punching unit 520 is moved by driving a punching motor (not shown) until reaching a die unit 521, and then is moved in the opposite direction. Thus, a plurality of punched holes (28 holes in this example) are punched in the specified aligned positions of the sheet P by pinching the sheet P between the punching unit 520 and the die unit 521. Punch waste yielded by the punching process is collected in a punch waste box 522.

When the punching process to the sheet P is finished after the punching unit 520 moves away from the die unit 521, a conveying roller pair 516 is driven to convey the sheet P, which has been stopped in the conveyance path 500*b*, to a buffer roller 574 by passing over a buffer path entrance sensor 576. The buffer roller 574 can temporarily retain conveyed sheets as a buffer unit. Sheets of a predetermined number conveyed via the conveying roller pair 516 can wind in piles around the buffer roller 574. A sheet winds around the outer circumference of the buffer roller 574 by depression rollers 571, 572, and 573 during the rotation. The wound sheets are conveyed in the direction of rotation of the buffer roller 574.

When guiding the sheet wound around the buffer roller 574 to the buffer path 500*c*, the switching flapper 570 is switched so that the sheet P is guided to the buffer path 500*c*. The sheet P is sent to the buffer path 500*c* in the condition of having been wound around the buffer roller 574. In the middle of the buffer path 500*c*, a buffer path sensor 575 for detecting the sheet on the buffer path 500*c* is mounted.

When the sheet wound around the buffer roller 574 is guided to a conveyance path 500*d*, the switching flapper 570 is switched so that the sheet P is guided to the conveyance path 500*d*. The sheet wound around the buffer roller 574 exfoliates, and this sheet is guided to the conveyance path 500*d* via a conveying roller pair 517. Then, when the rear edge of the sheet P is detected by an ejection sensor 526 arranged at the upstream side of an ejecting roller pair 518, the conveyance speed of the sheet P will be changed to predetermined speed V, and the sheet P will be ejected to a stacking tray 530. In this embodiment, the predetermined speed V is set to 300 mm/s. When the speed of the sheet P ejected to the loading tray 530 is too slow, the rear edge of the sheet P will lean on the ejecting roller pair 518 at the time when the sheet P is ejected to the stacking tray 530. On the other hand, when the ejecting speed is too high, the sheet P may jump over the stacking tray 530. Therefore, the ejection speed is always controlled to be the predetermined speed.

Next, an operation of a sheet stacking unit B shown in FIG. 3 will be described.

Since the sheet P is ejected one by one to the stacking tray 530 from the ejecting roller pair 518 at the predetermined speed as mentioned above, the sheet P lands on the stacking tray 530 without leaning on the ejecting roller pair 518. Since the stacking tray 530 slants upstream in the ejecting direction as shown in FIG. 3, the sheet P landed moves back to the upstream side in the ejecting direction by self-weight, and contacts a butted member. Accordingly, the sheet edges of the sheet bundle 540 are aligned in the ejecting direction.

Width alignment members 531 are mounted on the stacking tray 530 at both sides of the sheet width. When the front edge of the sheet P reaches the ejecting roller pair 518, the width alignment members 531 stand by at positions 10 mm apart from the sheet edges at the both edges in the width direction. After the sheet P lands on the stacking tray 530, each of the width alignment members 531 moves 10 mm close to the side edge of the sheet so that the side edges of the sheets are aligned in the direction perpendicular to the ejecting direction.

It is determined whether the sheet P lands on the stacking tray 530 according to elapsed time from the timing when the rear edge of the sheet P passes through the ejecting roller pair 518. The timing when the rear edge of the sheet P passes through the ejecting roller pair 518 can be easily determined from the conveyance distance or driving time of the ejecting roller pair 518 after the ejection sensor 526 detects the rear edge of the sheet P. Whenever a sheet is ejected onto the stacking tray 530, the width alignment members 531 repeat the sheet alignment operations to align the sheets in the width direction. As mentioned above, the edges of the sheets in the ejecting direction are aligned by the self-weight. Therefore, the sheets on the stacking tray 530 are aligned in both the ejecting and width directions to form a sheet bundle 540

Next, operations of a bookbinding unit C shown in FIG. 3 will be described.

Figure 5A:
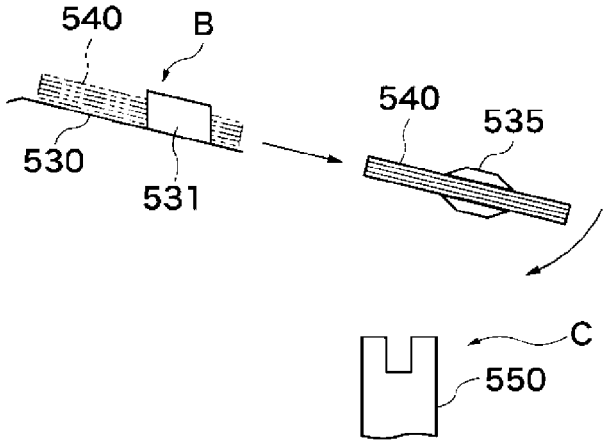
FIGS. 5A, 5B, and 5C are the views showing a bookbinding operation of the ring bookbinding apparatus in FIG. 3.
Figure 5B:
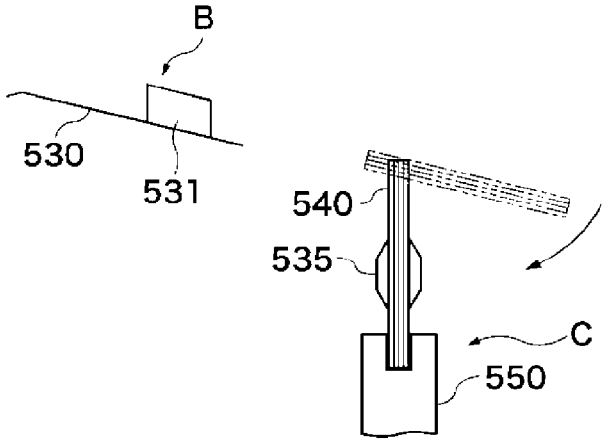

The sheet bundle 540, which is stacked and aligned on the stacking tray 530, is grasped by a gripper 535 on the stacking tray 530 and is moved to the position above the bookbinding unit C from the sheet stacking unit B as a bundle as shown in FIG. 5A. As shown in FIG. 5B, the sheet bundle 540, which has been moved above the bookbinding unit C by the gripper 535, is turned so that the edge of bundle to be bound by rings face downward while being grasped by the gripper 535.

Next, a configuration of a ring supplying unit 550 in the bookbinding unit C will be described using FIG. 6A and FIG. 6B.

Figure 6A:
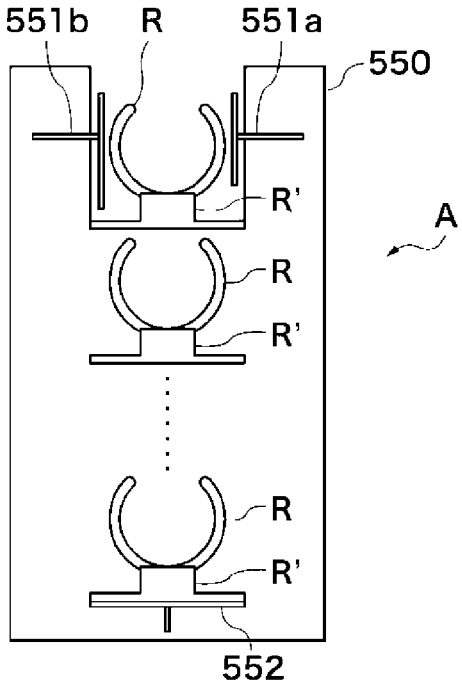
FIG. 6A is a longitudinal sectional view showing an outline structure of a ring supplying unit of the ring bookbinding apparatus in FIG. 3.
Figure 6B:
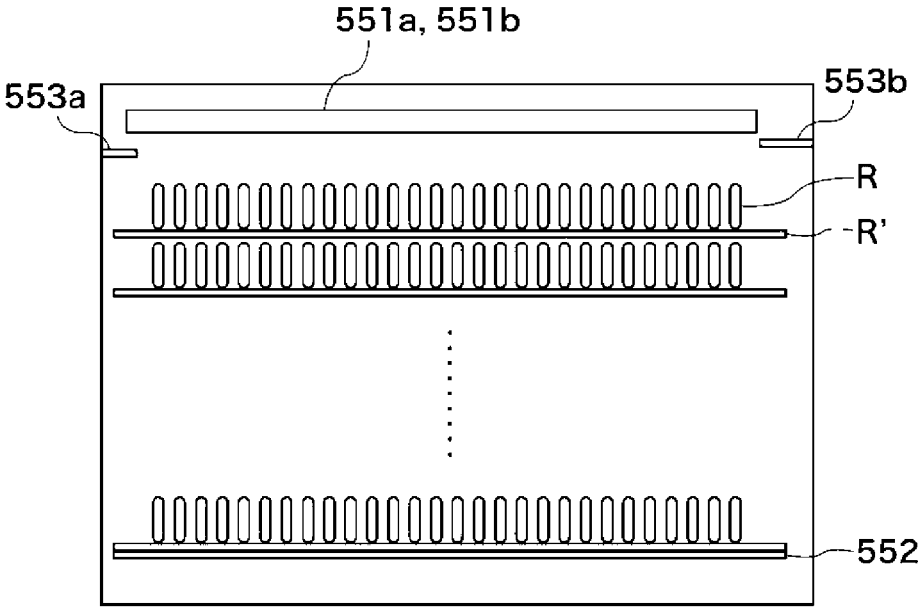
FIG. 6B is a longitudinal sectional view showing an outline structure of the ring supplying unit in FIG. 6A viewed in the direction A.

As shown in FIG. 6A and FIG. 6B, a ring member R consists of a plurality of ring elements (28 pieces in this example) each of which opens at its upper edge. The ring elements are connected to a ring support R' at equal intervals in a line. A plurality of combinations of the rings R and the ring supports R' are stored in the ring supplying unit 550. The bookbinding unit C performs a ring bookbinding process to a sheet bundle by controlling the gripper 535 and the ring supplying unit 550. The ring supplying unit 550 consists of ring clamping members 551*a* and 551*b*, a ring lift 552, and a motor (not shown) that drives them, as shown in FIG. 6A.

As shown in FIG. 6B, the ring clamping members 551*a* and 551*b* have length almost equal to the length of the ring member R in the longitudinal direction. The ring clamping members 551*a* and 551*b* are movable horizontally, and pick up the ring to attach the ring member R to the sheet bundle. The ring lift 552 is movable vertically, and pushes out the rings R, which are stacked vertically, upward. The ring support R' supports the ring member R so that the openings of the ring members are always directed upward. The ring support R' is easily separated from the ring member R by applying slight force. The ring support R' separated from the ring member R that is attached to the sheet bundle is ejected into the ring support box 554 shown in FIG. 3.

In FIG. 6B, holding latches 553*a* and 553*b* separate the ring member R from the ring support R'.

Next, a ring attachment process to the sheet bundle 540 in the bookbinding unit C will be described with reference to FIG. 7A through FIG. 7E.

Figure 7A:
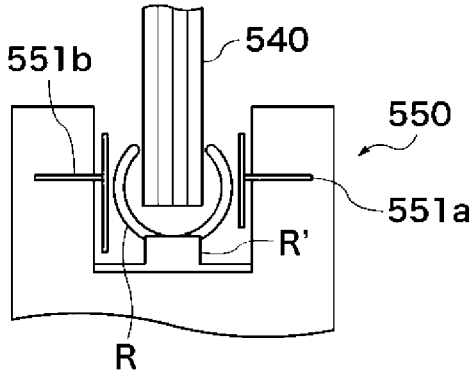
FIGS. 7A, 7B, 7C, 7D, and 7E are views showing a ring attachment operation of the ring bookbinding apparatus in FIG. 3.
Figure 7B:
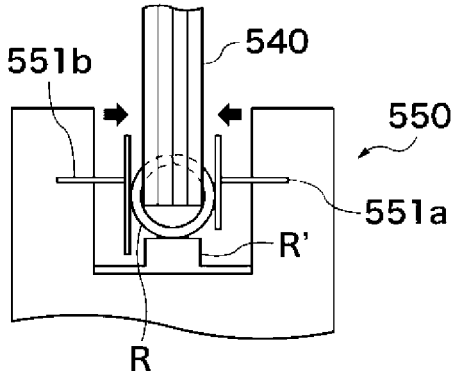

As shown in FIG. 7A, the bottom end of the sheet bundle 540 is inserted into a concave portion of the ring supplying unit 550 that is ready to supply the ring member R. When the lower edge of the sheet bundle 540 has been inserted into the ring supplying unit 550, the ring clamping members 551*a* and 551*b* move in the directions of the arrows in FIG. 7B, respectively, to deform the ring members of the ring member R so that the openings of the ring members close. As a result, the ring member R is attached to the sheet bundle 540. That is, the ring attachment process is applied to the sheet bundle 540 by connecting the opening edges of each ring member through a punch hole of the sheet bundle 540.

Figure 7C:
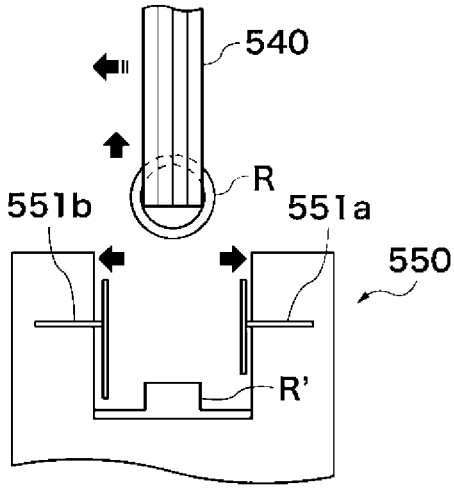

When the ring attachment process is completed, the ring clamping members 551*a* and 551*b* are evacuated in the directions of the arrows in FIG. 7C, and the sheet bundle 540 starts rising. Although the ring support R' also rises with the ring member R, the ends of the ring support R' are caught in the holding latches 553*a* and 553*b* when the ring support R' rises in a prescribed distance. Then, when the sheet bundle 540 raises while the ring support R' is caught in the holding latches 553*a* and 553*b*, the ring support R' is separated from the ring member R, and only the ring support R' remains in the ring supplying unit 550.

Figure 7D:
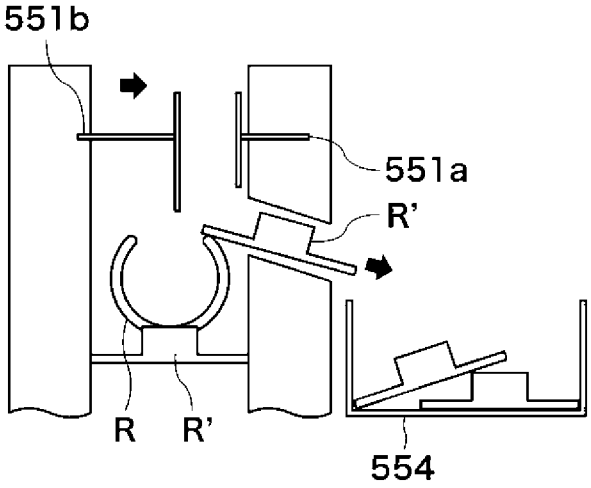

When only the ring support R' has remained in the ring supplying unit 550 and the ring clamping member 551*b* is driven in the direction of the arrow in FIG. 7D, the ring support R' separated from the ring member R is ejected into the ring support box 554.

Figure 7E:
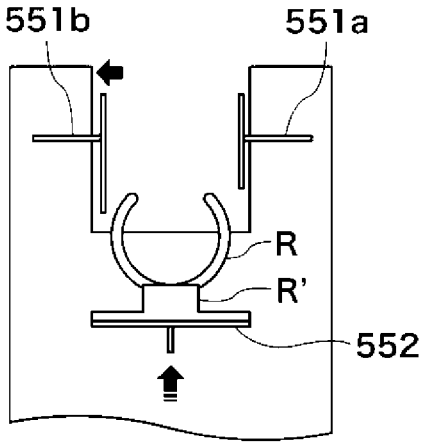

Finally, because the ring clamping member 551*b* is evacuated in the direction of the arrow in FIG. 7E and the ring lift 552 raises, it follows that a plurality of rings R stored in the longitudinal direction in the ring supplying unit 550 are pushed out upward. Then, a new ring member R is set in the concave portion of the ring supplying unit 550.

Figure 5C:
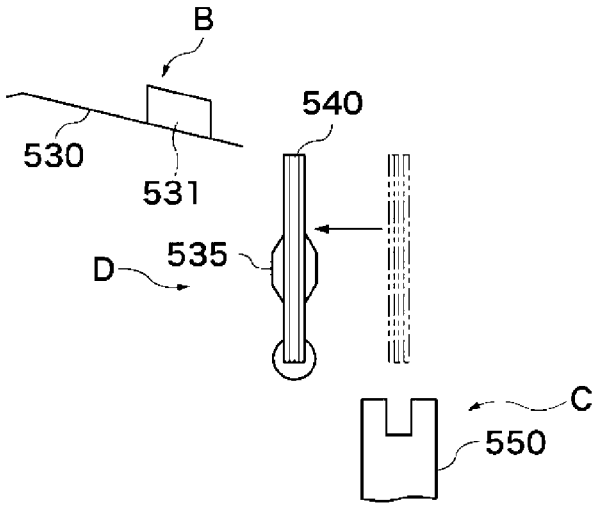

As shown in FIG. 5C, the sheet bundle 540 to which the ring member R has been attached moves horizontally in the direction of the illustrated arrow to a bound book ejection unit D while being grasped by the gripper 535. The sheet bundle 540 moved to the bound book ejection unit D is rotated in the clockwise direction by the gripper 535, as shown in FIG. 3. When the rotation of the sheet bundle 540 is completed, the holding operation of the gripper 535 is released. As a result, the sheet bundle 540 falls to an ejection tray 560 via a slope 561 by the self-weight.

Since the ejection tray 560 slants downstream in the ejecting direction as shown in FIG. 3, the landed sheet bundle 540 moves downstream in the ejecting direction, and contacts a butted member. Accordingly, the sheet edges of the sheet bundle 540 are aligned in the ejecting direction.

Next, a buffering operation by the buffer roller 574 will be described with reference to FIG. 8A through FIG. 8E. It should be noted that the buffering operation buffers sheets for a second sheet bundle so that the sheets for the second sheet bundle are not ejected onto a first sheet bundle until the first sheet bundle in the bookbinding process is ejected from the stacking tray 530.

FIG. 8A through FIG. 8E are views showing the buffering operation by the buffer roller 574.

Figure 8A:
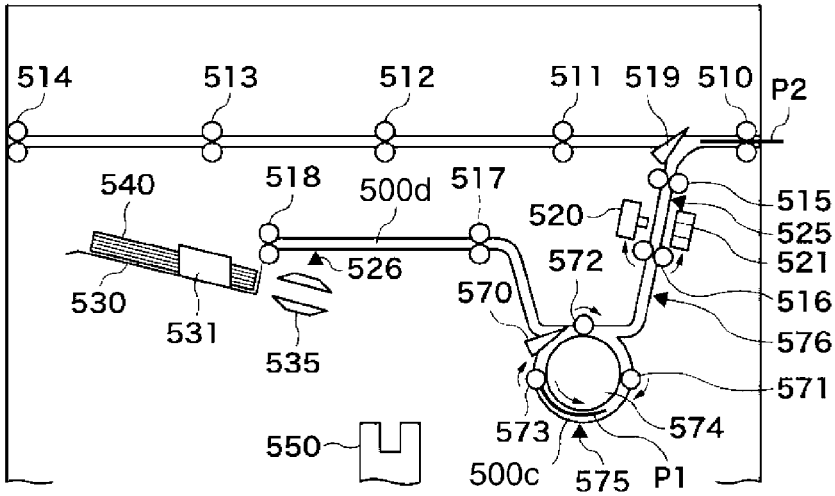
FIGS. 8A, 8B, 8C, 8D, and 8E are views showing a buffer operation by a buffer roller of the ring bookbinding apparatus in FIG. 3.
Figure 8B:
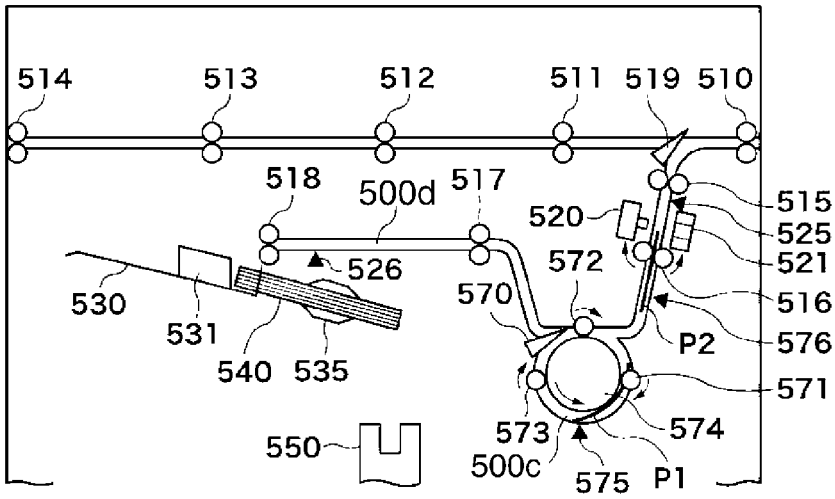
Figure 8C:
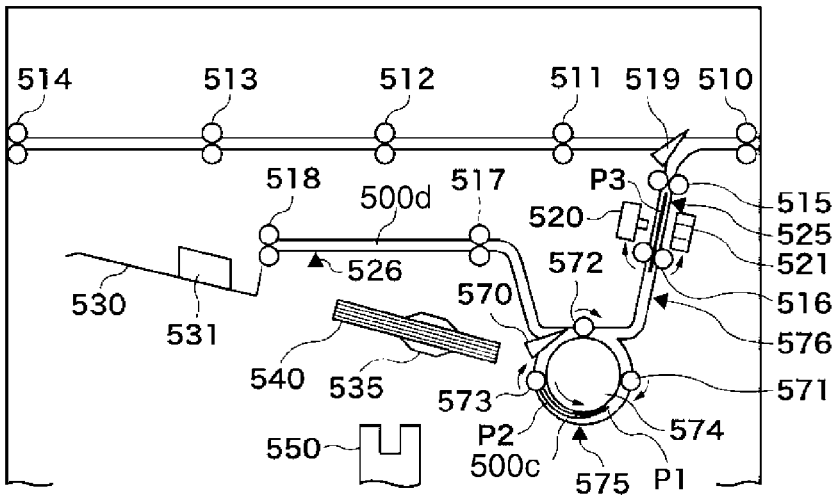

A sheet P1 as a first page of a second sheet bundle ejected from the image forming apparatus 10 is wound around the buffer roller 574 by an operation of the switching flapper 570 as shown in FIG. 8A. The buffer roller 574 stops when the sheet P1 is conveyed by a prescribed distance from the buffer path sensor 575. When a front edge of a sheet P2 as a next page proceeds by the prescribed distance from the buffer path entrance sensor 576, the buffer roller 574 starts rotating as shown in FIG. 8B, and then, the sheet P2 is piled up on the sheet P1. As shown in FIG. 8C, the sheet P2 is wound around the buffer roller 574 while being piled on the sheet P1, and the sheets P1 and P2 are sent to the buffer path 500*c*. The buffer roller 574 stops again when the sheet P2 is conveyed by the prescribed distance from the buffer path sensor 575.

Figure 8D:
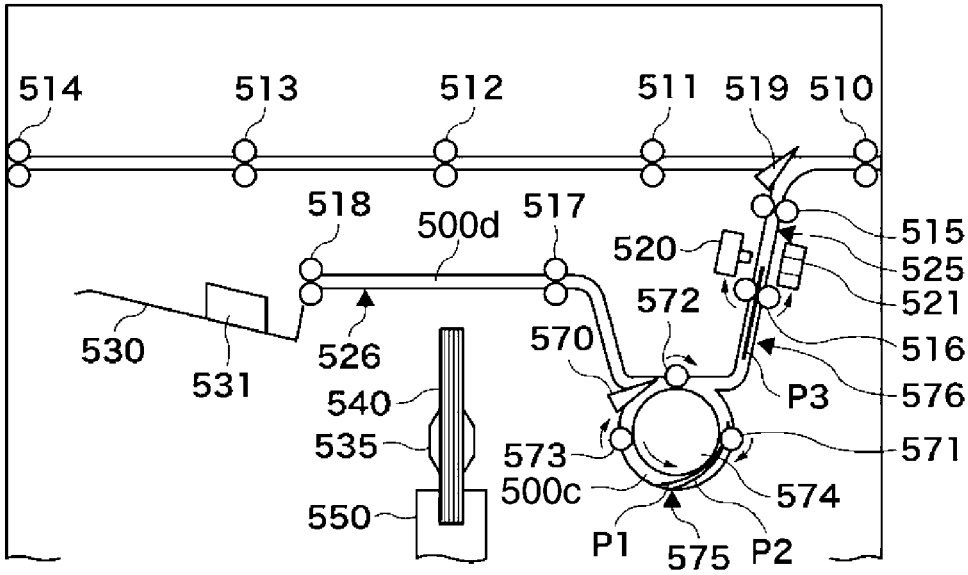
Figure 8E:
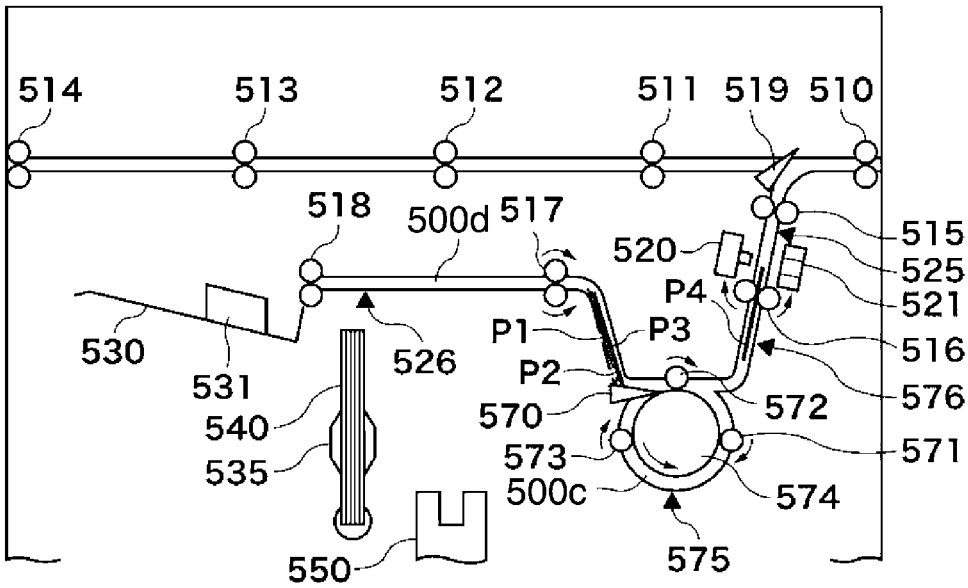

When a front edge of a sheet P3 as a next page proceeds by the prescribed distance from the buffer path entrance sensor 576, the buffer roller 574 again starts rotating as shown in FIG. 8D, and then, the sheet P3 is piled up on the bundle of the sheets P1 and P2. The sheets P1, P2, and P3 wound around the buffer roller 574 are separated from the buffer roller 574 by the switching flapper 570, and they are conveyed to the conveyance path 500*d* as a sheet bundle of three sheets (see FIG. 8E). At this time, since the previous sheet bundle has been gripped and conveyed out of the stacking tray 530, the next sheet bundle of the three sheets P1, P2, and P3 is stacked on the blank stacking tray 530.

Fourth or later sheet passes through the conveyance path 500*d* and is ejected to the stacking tray 530 by switching the switching flapper 570. The same operation is performed repeatedly to the second or later sheet bundle, and set number of ring bookbinding bundles are stacked onto the ejection tray 560.

It should be noted that a sheet made from sticky material (an OHP sheet, a coated sheet, etc.) is prohibited from buffering because such a sheet may stick each other.

Next, the bookbinding control unit that controls the ring bookbinding apparatus 500 of FIG. 3 will be described with reference to FIG. 9.

Figure 9:
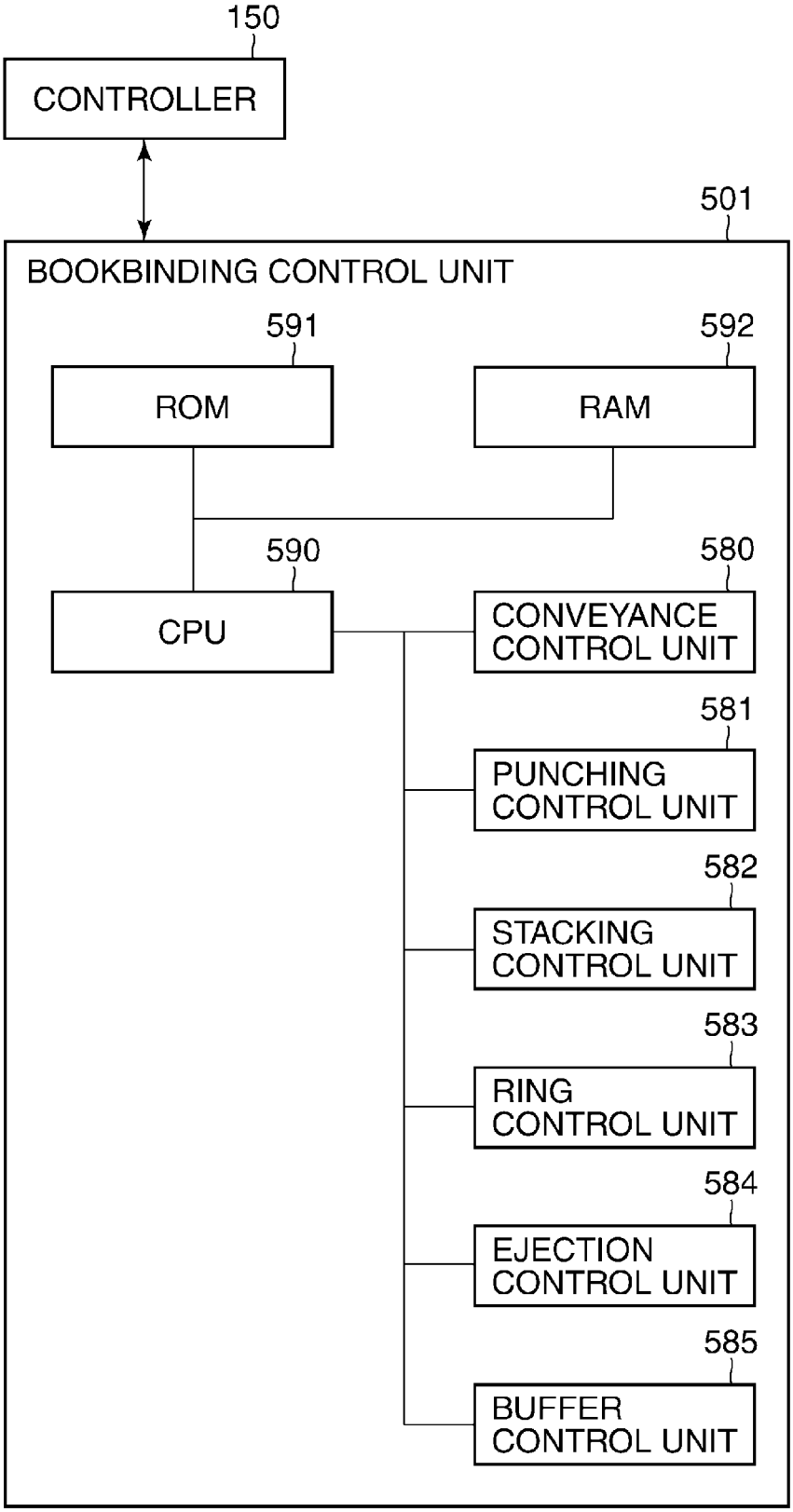
FIG. 9 is a block diagram schematically showing a configuration of a bookbinding control unit that controls the ring bookbinding apparatus in FIG. 3.

FIG. 9 is a block diagram schematically showing a configuration of the bookbinding control unit that controls the ring bookbinding apparatus 500 in FIG. 3. It should be noted that elements shown in FIG. 9 include hardware modules and software modules.

The bookbinding control unit 501 is arranged in the ring bookbinding apparatus 500, and as shown in FIG. 9, it comprises a CPU 590, a ROM 591, a RAM 592, etc. The CPU 590 communicates with the controller 150 arranged in the image forming apparatus via a communication IC (not shown) to exchange data, and executes various programs stored in the ROM 591 according to instructions from the controller 150 to control and drive the ring bookbinding apparatus 500.

The bookbinding control unit 501 is provided with a conveyance control unit 580, which controls the sheet conveyance through the conveyance paths 500*a* and 500*b* by the conveying roller pairs 510 through 518 mentioned above, as a drive control unit for monitoring the various sensors and for driving the loads. The bookbinding control unit 501 is provided with a punching control unit 581 that drives the sheet punching unit A, and a stacking control unit 582 that drives the sheet stacking unit B. The bookbinding control unit 501 is provided with a ring control unit 583 that drives the ring bookbinding unit C, an ejection control unit 584 for driving the bound book ejection unit D that ejects a bound booklet to the ejection tray 560, and a buffer control unit 585 that drives the sheet conveyance in the buffer path 500*c*.

Next, a procedure for the setting method of the ring bookbinding mode in the image forming system in FIG. 1 will be described with reference to FIG. 10 and FIG. 11A through FIG. 11F.

Figure 10:
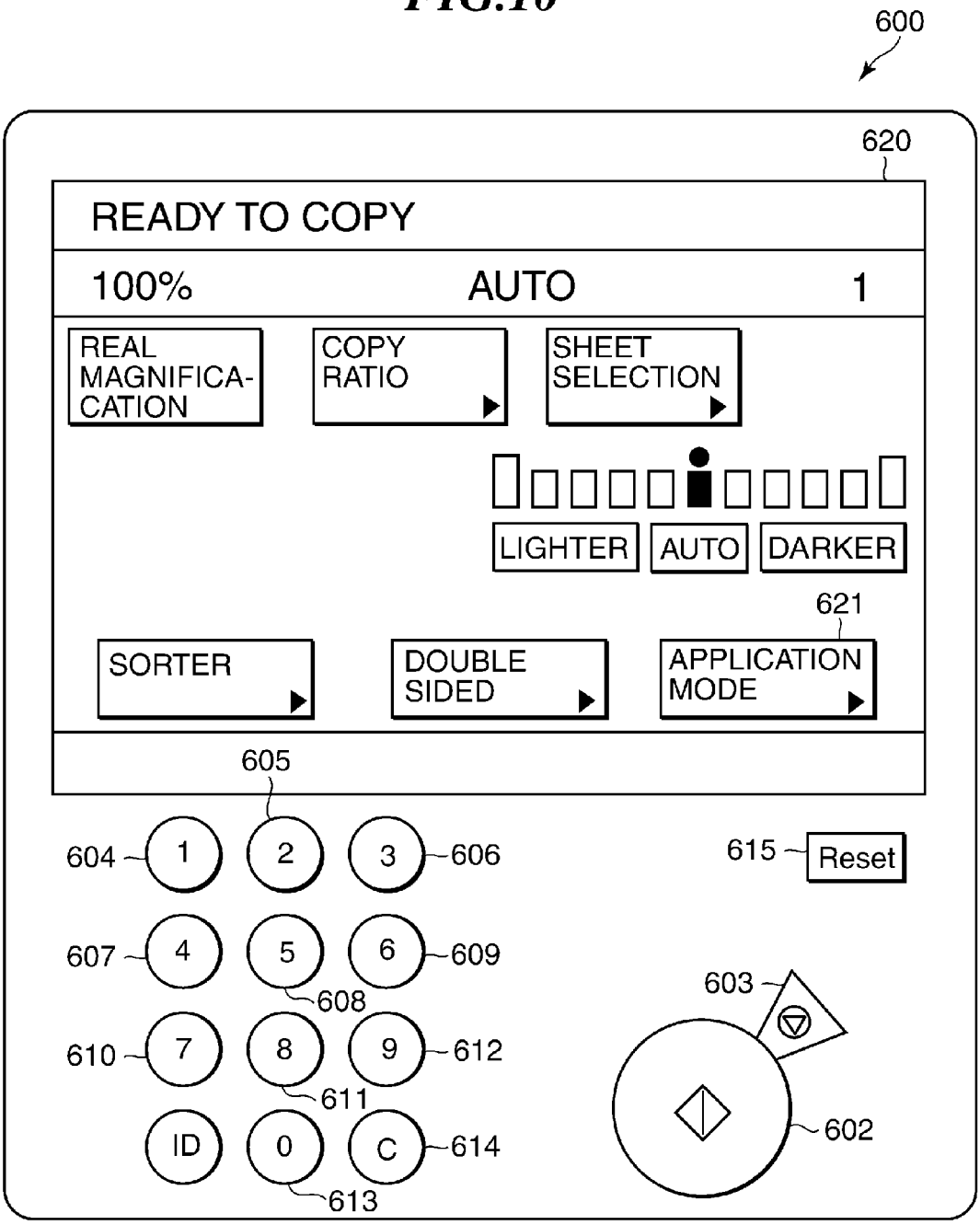
FIG. 10 is a view showing an operation display unit of the image forming apparatus in FIG. 1 with a screen example.

FIG. 10 is a view showing an example of a screen displayed on the operation display unit 600. FIG. 11A through FIG. 11F are views for describing the setting method of the ring bookbinding mode on a screen.

A start key 602 for starting an image forming operation, a stop key 603 for interrupting the and an image forming operation, ten-digit keys 604 through 613 for setting variables, a clear key 614, a reset key 615, etc. are arranged in the operation display unit 600 shown in FIG. 10. An application mode key 621 etc. are arranged in a display unit 620 in which a touch panel is formed in the upper area. A soft key can be formed on a screen of the display unit. The set information set on the operation display unit 600 is transmitted to the controller 150 via the operation display control unit 601.

Figure 11A:
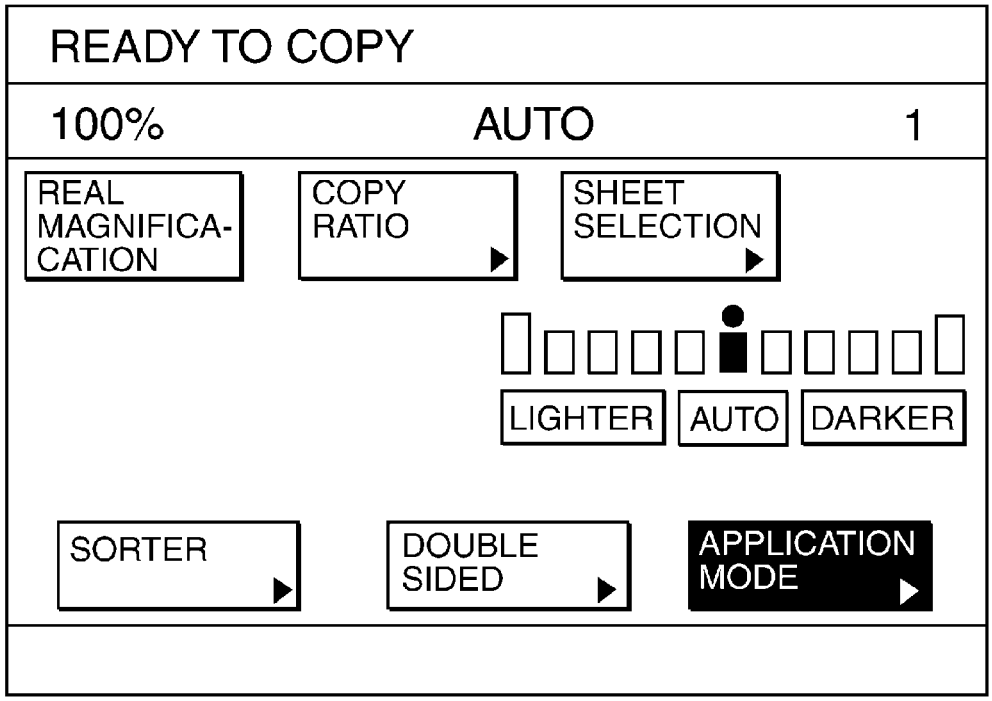
FIGS. 11A, 11B, 11C, 11D, 11E, and 11F are views showing screens displayed on the operation display unit in FIG. 10 in a ring bookbinding mode.
Figure 11B:
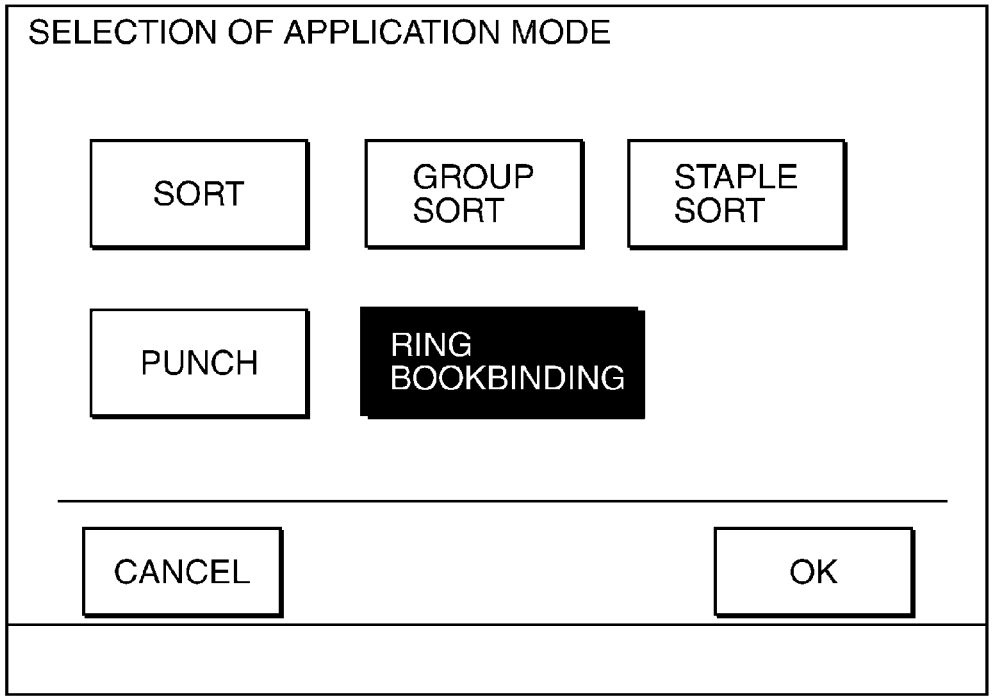
Figure 11C:
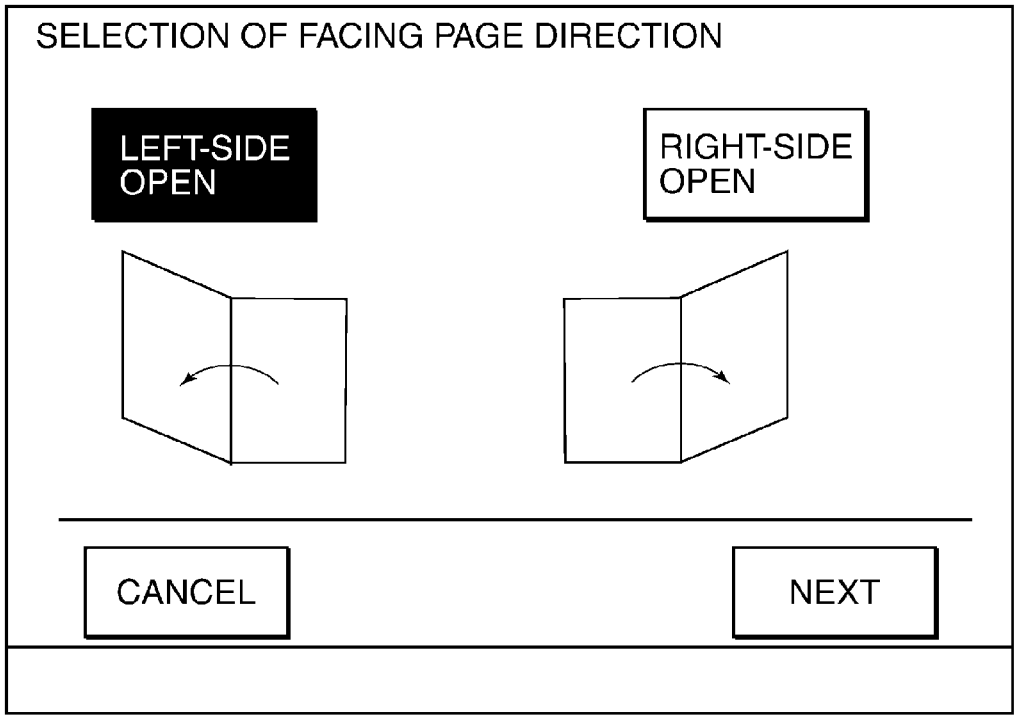

The ring bookbinding mode is set on the display unit 620. When an "application mode" soft key is selected on an initial screen shown in FIG. 11A, the screen is changed to a selection screen in the application mode as shown in FIG. 11B. When a "ring bookbinding" soft key is selected from the menu in the application mode, a setting in the ring bookbinding mode starts.

First, either a "right-side open" or a "left-side open" is selected as a facing page direction of a product (FIG. 11 C). A "right-side open" book increases the page number from the right side page to the left side page, and a "left-side open" book increases the page number from the left side page to the right side page. After the facing page direction ("left-side open" in this example) is selected, when a "next" soft key is pushed, the screen is changed to a screen shown in FIG. 11D.

Figure 11D:
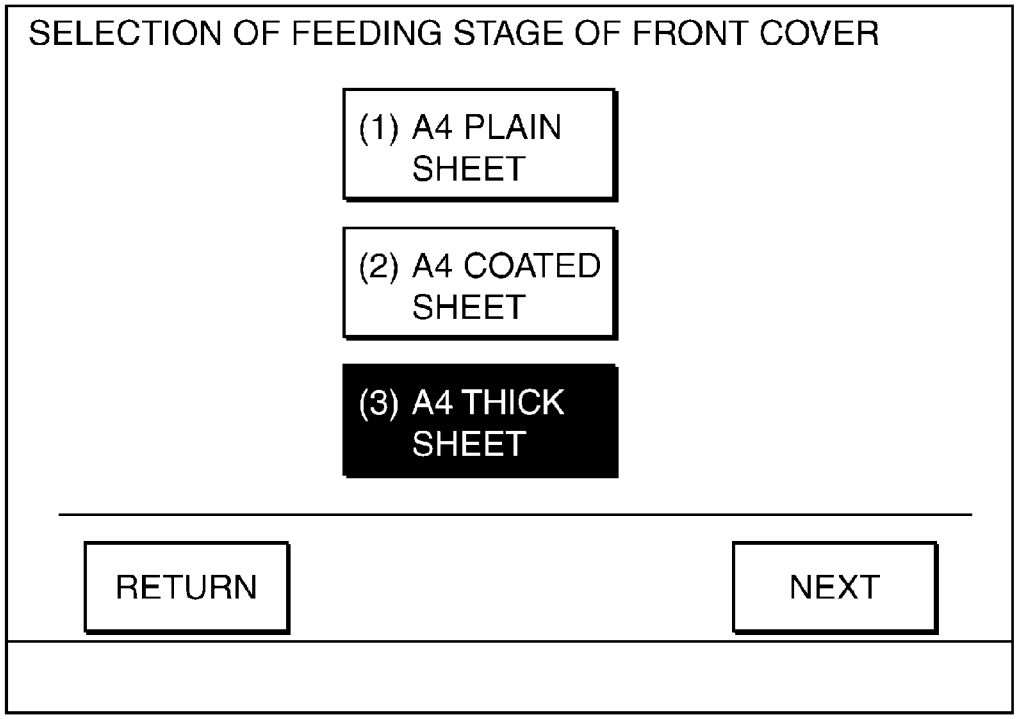
Figure 11E:
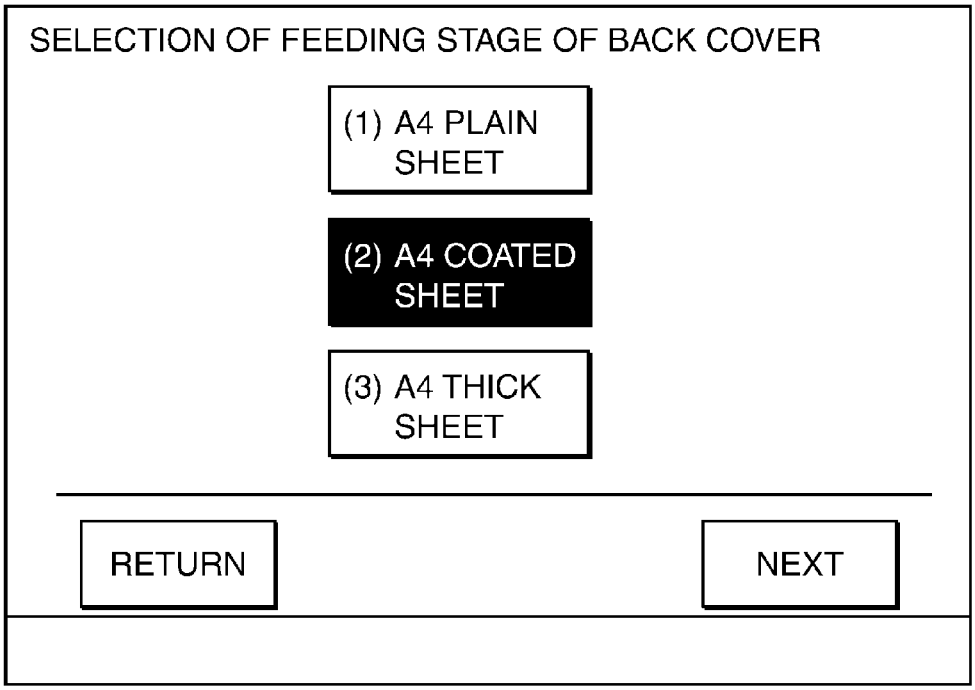
Figure 11F:
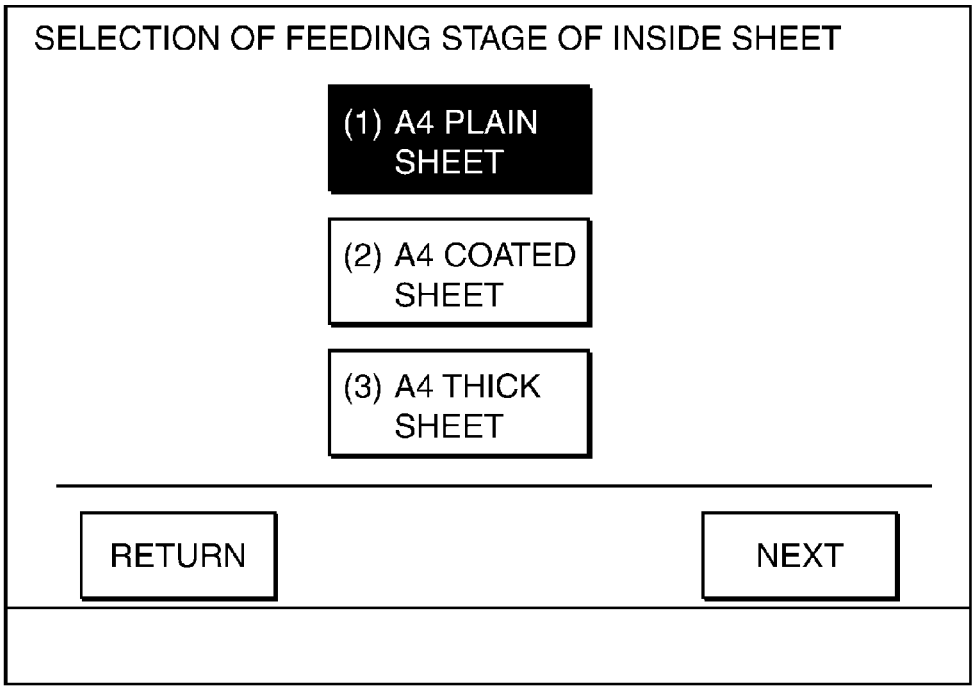

In the screen shown in FIG. 11D, a feeding stage from which a front cover of a ring bookbinding bundle (sheet bundle) is fed can be selected. After the feeding stage of the front cover is selected, the screen is changed to a screen shown in FIG. 11E. In the screen shown in FIG. 11E, the feeding stage from which a back cover of the ring bookbinding bundle is fed can be selected. When the feeding stage of the back cover is selected, the screen is changed to a screen shown in FIG. 11F. In the screen shown in FIG. 11F, the feeding stage from which an inside sheet of the ring bookbinding bundle is fed can be selected. Thus, a user can select the feeding stages (materials) of the sheets for the front cover, the back cover, and the inside sheet, respectively, on the operation display unit (a setting unit) 600. Although three types of sheets serve as selection targets in FIG. 11D through FIG. 11F, four or more types of sheets may serve as the selection targets.

The setting in the ring bookbinding mode is completed according to the above method.

Next, a control method for adjusting a page order of sheets in a sheet bundle so as to set a sheet suitable to be buffered by the buffer roller 574 to the top of the sheet bundle will be described.

Figure 12:
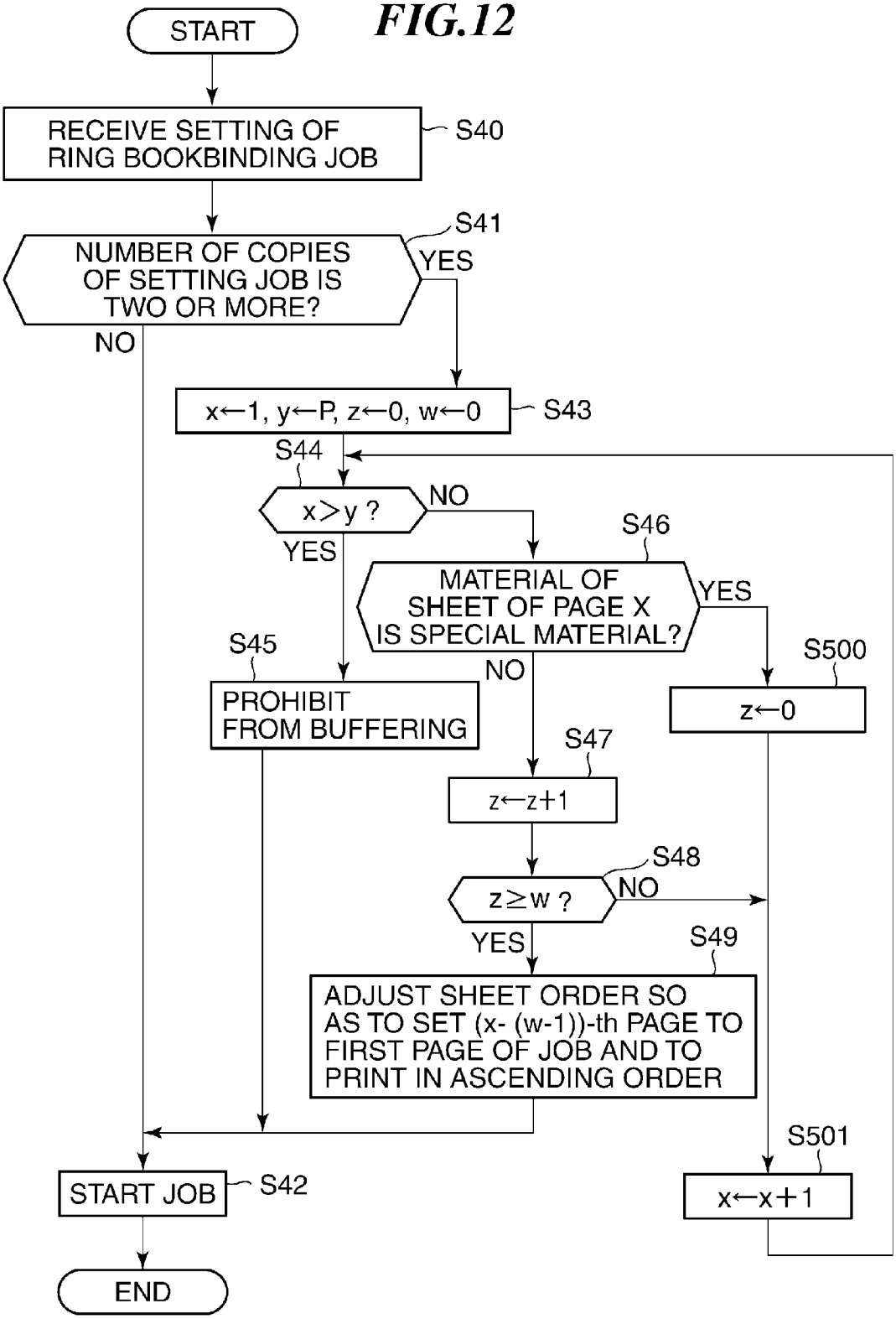
FIG. 12 is a flowchart showing a page order adjustment process according to the first embodiment of the present invention.

FIG. 12 is a flowchart showing a page order adjustment process according to the first embodiment of the present invention.

The controller 150 receives the job setting in the ring bookbinding mode set by a user from the operation display unit 600 (step S40). In step S41, the controller 150 determines whether the number of copies of the received job setting is two or more. When it is determined that the number of copies of the job setting is one (NO in the step S41), the process proceeds to step S42, and the job starts as-is. In this case, the buffer roller 574 does not buffer a sheet. On the other hand, when it is determined that the number of copies of the job setting is two or more, the process proceeds to step S43.

In the step S43, the controller 150 substitutes 1 for a page number x showing a target page to determine whether the material of the set sheet is special material. Then, the sheet number P of the set job is substituted for a sheet number y of one copy of the job. Further, the controller 150 substitutes 0 for a variable z that counts up when the material of the sheet set in the page number x is not the special material. Further, the controller 150 substitutes a predetermined number of sheets Q that the ring bookbinding apparatus buffers for a variable w, and proceeds with the process to step S44. The material of the set sheet has been set on the operation display unit 600, as shown in FIG. 10 and FIG. 11A through FIG. 11F.

In the step S44, the controller 150 compares the page number x with the sheet number y in order to determine whether the page number x as the target to determine the material of the set sheet is over the last page of the job. As a result, when it is determined that the page number x is more than the sheet number y (YES in the step S44), the process proceeds to step S45. On the other hand, when it is determined that the page number x is below the sheet number y, the process proceeds to step S46.

In the step S45, the controller 150 prohibits the buffering operation mentioned above, and then proceeds with the process to the step S42 to start the job.

In the step S46, the controller 150 determines whether the material of the x-th sheet is the special material. Here, the controller 150 determines whether the material of the sheet of the page number x is the special material like a coated sheet or an OHP sheet, which is prohibited from buffering, in the job set on the operation display unit 600. The process in the step S46 is an example of a determination step.

When determining that the material of the set sheet is the special material in the step S46, the controller 150 proceeds with the process to step S500 to clear the variable z, and then proceeds with the process to step S501. On the other hand, when determining that the material of the set sheet is not the special material, the controller 150 proceeds with the process to the step S47 to add 1 to the variable z, and proceeds with the process to step S48. The controller 150 determines that material of a coated sheet or an OHP sheet is the special material.

In the step S48, the controller 150 compares the variables w and z to determine whether a predetermined number of sheets of which material is not the special material continue. When the variable z is equal to or more than the variable w, the process proceeds to step S49.

In step S49, the controller 150 reads image data stored in the RAM 153 in ascending order from (x−(w−1))-th page to set the page number at the time when the variable z reaches the variable w first to the first page of the job. Then, the controller 150 adjusts the sheet order (the image formation order) so as to print in ascending order, and then proceeds with the process to the step S42 to start the job. On the other hand, the variable z progresses to step S501, when smaller than the variable w. In step S501, the controller 150 adds 1 to the page number x, and returns the process to the step S44.

According to the above-mentioned process, when the sheets that should be bound are ejected to the ring bookbinding apparatus 500, the ejection order is adjusted so that a sheet of the special material is not ejected within a predetermined number of sheets from the first sheet of each sheet bundle. That is, the ejection order is adjusted so that a sheet of the spatial paper is not buffered.

The following description assumes that a job makes two copies of ring bookbinding bundles each of which consists of two OHP sheets for front and back covers and three plain sheets for inside sheets and that the predetermined number of buffered sheets Q is 2, for example.

Since the one copy of the job consists of five sheets, the front cover is the special material, and the first and second inside sheets are not the special material, the image forming apparatus 10 ejects the first inside sheet, the second inside sheet, the third inside sheet, the back cover, and the front cover in this order with face-down. As a result, the buffer roller 574 buffers the first inside sheet and the second inside sheet, but the third inside sheet, the back cover, and the front cover are conveyed without being buffered. At this time, the controller 150 sequentially executes the steps S41, S43, S44, S46, S500, S501, S44, S46, S47, S48, S501, S44, S46, S47, S48, S49, and S42 in FIG. 12.

Figure 13A:
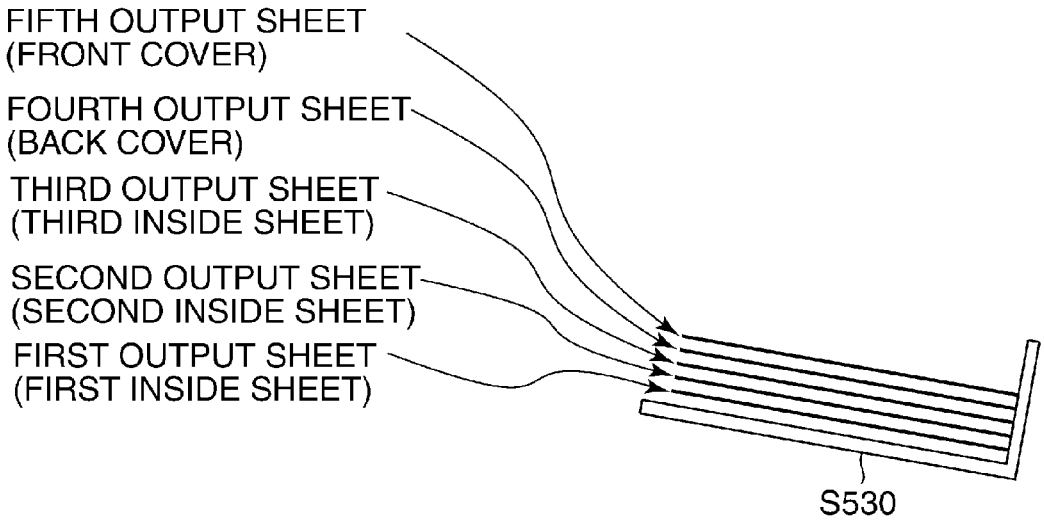
FIG. 13A is a view showing a sheet bundle stacked on a loading tray according to the first embodiment.
Figure 13B:
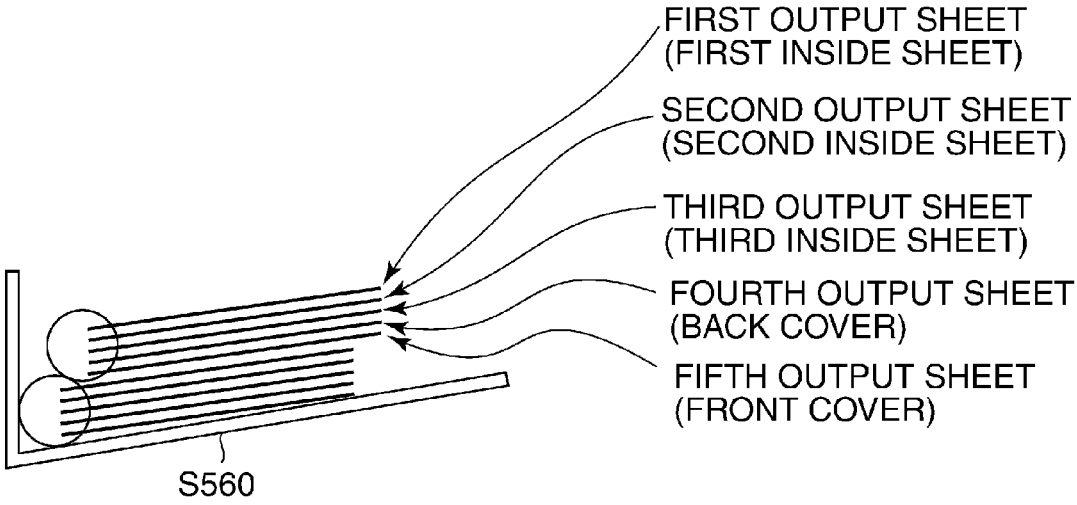
FIG. 13B is a view showing the ring bookbinding bundles ejected to an ejection tray according to the first embodiment.

The sheet bundle is stacked onto the stacking tray 530 as shown in FIG. 13A. Next, the ring bookbinding unit C binds the sheet bundles and ejects the ring bookbinding bundles onto the ejection tray 560 as shown in FIG. 13B.

Even if the sheets of the ring bookbinding bundle are not arranged in the order from the first page (the front cover), the ring bookbinding bundle in the correct page order can be obtained by turning the front cover that is arranged at the outermost of the ring bookbinding bundle to the opposite side of the sheet bundle along the ring.

According to the first embodiment mentioned above, when an OHP sheet or a coated sheet is set as the first page of the sheet bundle to be bound, the ejection order is adjusted to buffer by changing the page order of sheets to which images are formed so as not to eject the sheet of the special material within the predetermined number of sheets from the first page. This enables to perform the bookbinding process for a plurality of sheet bundles without lowering productivity.

Since a second embodiment of the present invention has the same configuration and function as the above-mentioned first embodiment, the duplicate descriptions will be omitted. Below, only different points from the above-mentioned first embodiment will be described.

Although the above-mentioned first embodiment describes the bookbinding method with the face-down ejection, the second embodiment describes the bookbinding method with the face-up ejection.

Figure 14:
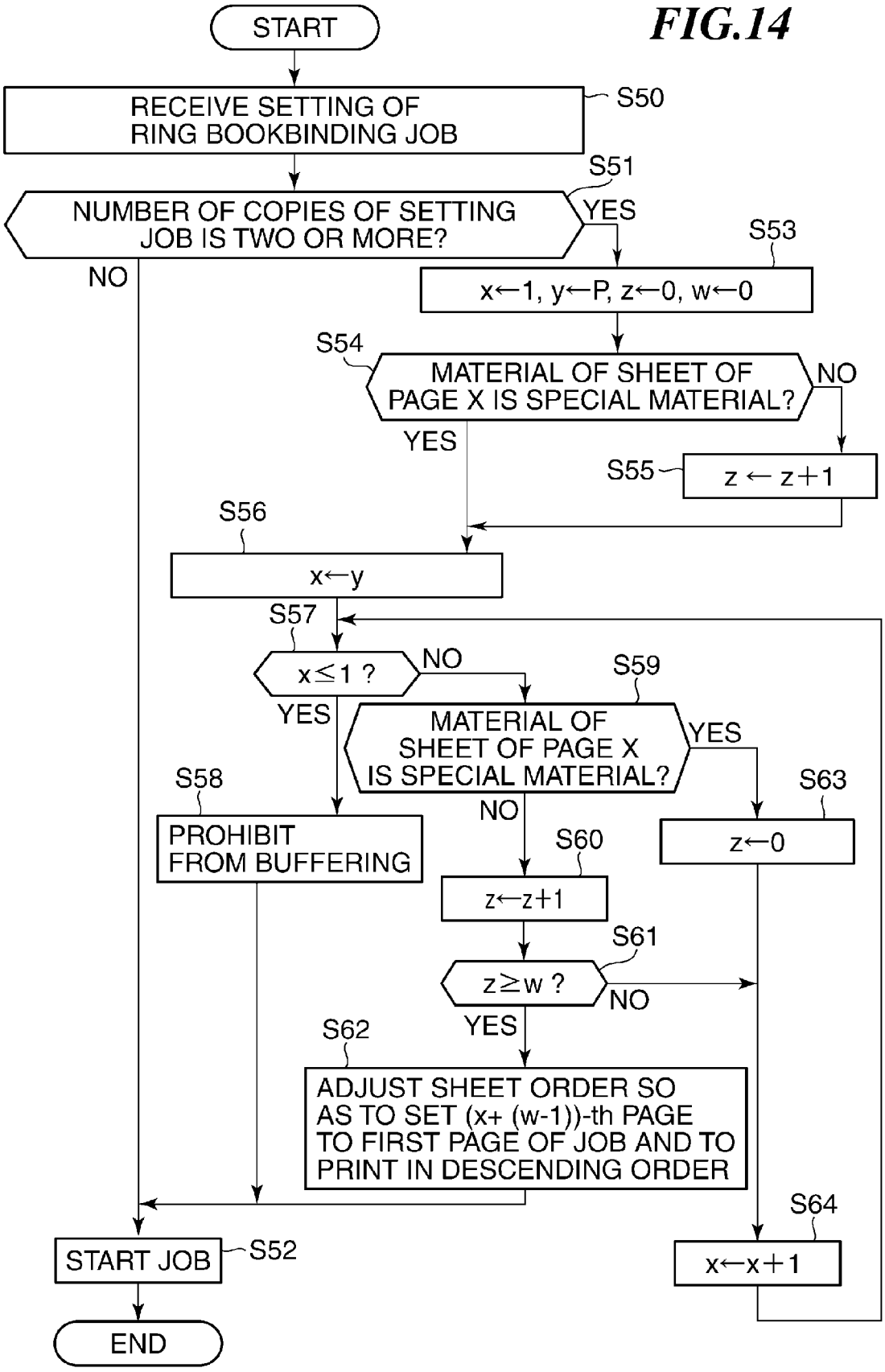
FIG. 14 is a flowchart showing a page order adjustment process according to a second embodiment of the present invention.

FIG. 14 is a flowchart showing a page order adjustment process according to the second embodiment of the present invention.

The controller 150 receives the job setting in the ring bookbinding mode set by a user from the operation display unit 600 (step S50).

In step S51, the controller 150 determines whether the number of copies of the received job setting is two or more. When it is determined that the number of copies of the job setting is one (NO in the step S51), the process proceeds to step S52, and the job starts as-is. In this case, the buffer roller 574 does not buffer a sheet. On the other hand, when it is determined that the number of copies of the job setting is two or more, the process proceeds to step S53.

In the step S53, the controller 150 substitutes 1 for a page number x showing a target page to determine whether the material of the set sheet is the special material. Then, the sheet number P of the set job is substituted for a sheet number y of one copy of the job. Further, the controller 150 substitutes 0 for a variable z that counts up when the material of the sheet set in the page number x is not the special material. Further, the controller 150 substitutes a predetermined number of sheets Q that the ring bookbinding apparatus buffers temporally for a variable w, and proceeds with the process to step S54. The material of the set sheet has been set on the operation display unit 600, as shown in FIG. 10 and FIG. 11A through FIG. 11F.

In the step S54, the controller 150 determines whether the material of the sheet of the page number x is the special material. Here, the controller 150 determines whether the material of the sheet of the page number x is the special material like a coated sheet or an OHP sheet, in the job set on the operation display unit 600. The process in the step S54 is an example of a determination step.

When determining that the material of the set sheet is not the special material in the step S54, the controller 150 proceeds with the process to step S55 to add 1 to the variable z, and then proceeds with the process to step S56. On the other hand, when determining that the material of the set sheet is the special material, the controller 150 proceeds with the process to the step S56 without performing the step S55. The controller 150 determines that material of a coated sheet or an OHP sheet is the special material.

In the step S56, the controller 150 substitutes the sheet number y of one copy of a job for page number x in order to determine whether the material of the set sheet is the special material from the last paper of the job in descending order, and proceeds with the process to step S57.

In the step S57, the controller 150 compares the page number x with 1 in order to determine whether the target page of which the material of the sheet is determined is the first page of the job. When the page number is equal to or less than 1, the process proceeds to step S58. On the other hand, when the page number x is more than 1, the process proceeds to step S59.

In the step S58, the controller 150 prohibits the buffering operation mentioned above, and then proceeds with the process to the step S52 to start the job.

In the step S59, the controller 150 determines whether the material of the sheet of the page number x is the special material. When determining that the material of the set sheet is the special material in the step S59, the controller 150 proceeds with the process to step S63 to clear the variable z, and then proceeds with the process to step S64. On the other hand, when determining that the material of the set sheet is not the special material, the controller 150 proceeds with the process to the step S60 to add 1 to the variable z, and proceeds with the process to step S61.

In the step S61, the controller 150 compares the variables z and w to determine whether a predetermined number of sheets of which material is not the special material continue. When the variable z is equal to or more than the variable w, the process proceeds to step S62.

In the step S62, the controller 150 reads image data stored in the RAM 153 in descending order from (x+(w−1))-th page to set the page number at the time when the variable z reaches the variable w first to the first page of the job. Then, the controller 150 adjusts the sheet order for printing, and then proceeds with the process to the step S52 to start the job. On the other hand, the variable z is less than the variable w, the process proceeds to the step S64.

In the step S64, the controller 150 subtracts 1 from the page number x, and returns the process to the step S57. According to the above-mentioned process, when the sheets that should be bound are ejected to the ring bookbinding apparatus 500, the ejection order is adjusted so that a sheet of the special material is not ejected within a predetermined number of sheets from the first sheet of each sheet bundle.

The following description assumes that a job makes two copies of ring bookbinding bundles each of which consists of two OHP sheets for front and back covers and three plain sheets for inside sheets and that the predetermined number Q is 2, for example.

Since the front and back covers are mode of the special material and the second and third inside sheets are not mode of the spatial paper, the third inside sheet, the second inside sheet, the first inside sheet, the front cover, and the back cover are ejected in this order from the image forming apparatus 10 with face-up. At this time, the controller 150 sequentially executes the steps S51, S53, S54, S56, S57, S59, S63, S64, S57, S59, S60, S61, S64, S57, S59, S60, S61, S62, and S52 in FIG. 14.

Figure 15A:
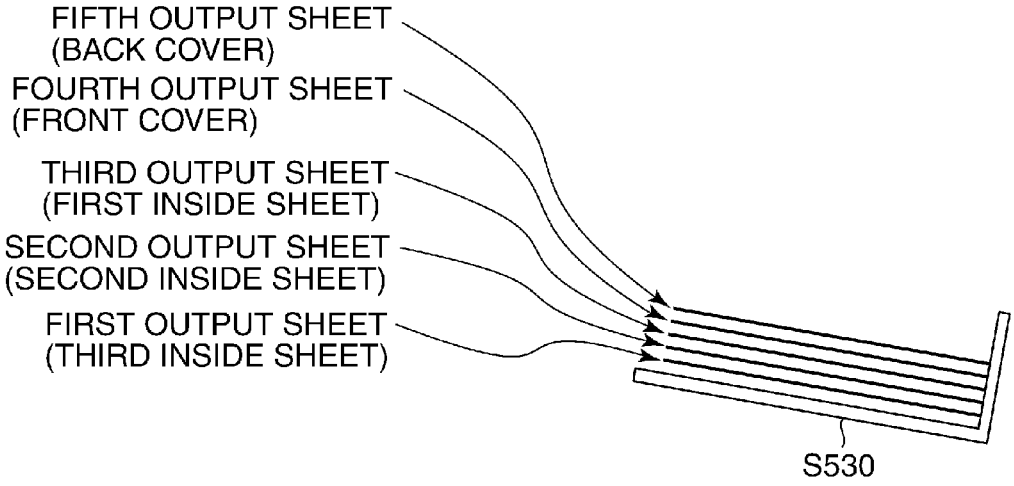
FIG. 15A is a view showing a sheet bundle stacked on the loading tray according to the second embodiment.
Figure 15B:
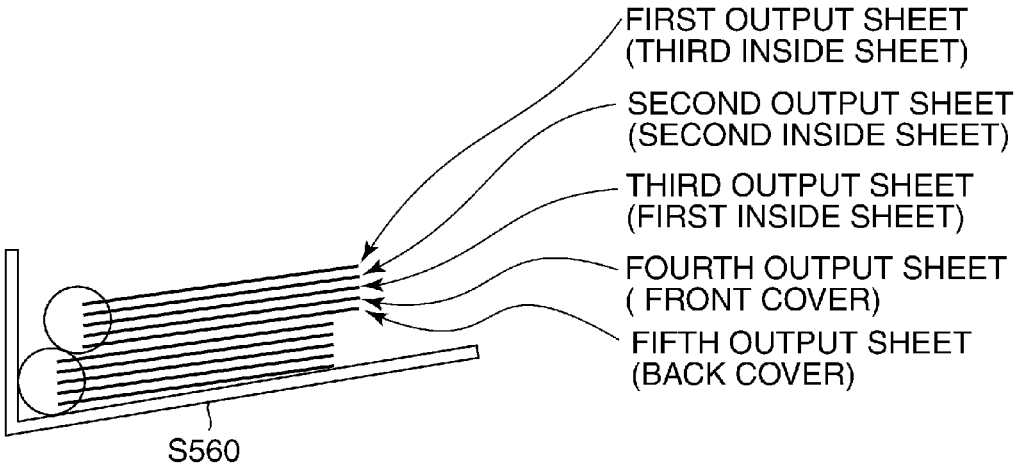
FIG. 15B is a view showing the ring bookbinding bundles ejected to an ejection tray according to the second embodiment.

The sheet bundle is stacked onto the stacking tray 530 as shown in FIG. 15A. Next, the ring bookbinding unit C binds the sheet bundles and ejects the ring bookbinding bundles onto the ejection tray 560 as shown in FIG. 15B.

The ring bookbinding bundle in the correct page order can be obtained by turning the back cover that is arranged at the outermost side of the ring bookbinding bundle to the opposite side of the sheet bundle along the ring.

The second embodiment enables to perform the bookbinding process for a plurality of sheet bundles without lowering productivity as with the above-mentioned first embodiment. The ejection order of the sheets can be changed according to the face-down ejection or face-up ejection to the ring bookbinding apparatus 500.

The image forming apparatus may be provided with both the function of the first embodiment and the function of the second embodiment.

The present invention may be applied to the ring bookbinding apparatus 500. In that case, the ring bookbinding apparatus 500 acquires the set information about the type of sheet to be bound from the image forming apparatus 10. Then, the present invention may be achieved by executing the process shown in FIG. 12 or FIG. 14 by the CPU 590 in the bookbinding control unit 501.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-209673, filed on Sep. 17, 2010, which is hereby incorporated by reference herein in its entirety.

What is claimed is:

1. An image forming apparatus that is connected to a bookbinding apparatus having a bookbinding unit that binds a book by attaching a ring to a punch hole of a sheet bundle and a buffer unit that performs a buffering process to convey a predetermined number of sheets in piles so that sheets for a next sheet bundle are not ejected onto a sheet bundle that is being processed by the bookbinding unit, the image forming apparatus comprising:

a determination unit configured to determine whether a sheet is a type that is prohibited from performing the buffering process by the buffer unit; and a control unit configured to adjust an ejection order so that the sheet of the type that is prohibited from performing the buffering process is not ejected within the predetermined number of sheets from the first sheet of sheets that constitute the sheet bundle, when said determination unit determines that the sheet is the type that is prohibited from performing the buffering process.

2. The image forming apparatus according to claim 1, wherein said determination unit determines that the sheet is a coated sheet or an OHP sheet as the type that is prohibited from performing the buffering process.

3. The image forming apparatus according to claim 1, wherein said control unit adjusts the ejection order of the second and later sheet bundles when a plurality of sheet bundles are processed.

4. An image forming system comprising:

an image forming unit configured to form an image onto a sheet;

a bookbinding unit configured to bind a book by attaching a ring to a punch hole of a sheet bundle that consists of a plurality of sheets on which images are formed;

a buffer unit configured to perform a buffering process to convey a predetermined number of sheets in piles so that sheets for a next sheet bundle are not ejected onto a sheet bundle that is being processed by said bookbinding unit;

a determination unit configured to determine whether a sheet is a type that is prohibited from performing the buffering process by said buffer unit; and a control unit configured to adjust an ejection order so that the sheet of the type that is prohibited from performing the buffering process is not ejected within the predetermined number of sheets from the first sheet of sheets that constitute the sheet bundle, when said determination unit determines that the sheet is the type that is prohibited from performing the buffering process.

5. A control method for an image forming apparatus that is connected to a bookbinding apparatus having a bookbinding unit that binds a book by attaching a ring to a punch hole of a sheet bundle and a buffer unit that performs a buffering process to convey a predetermined number of sheets in piles so that sheets for a next sheet bundle are not ejected onto a sheet bundle that is being processed by the bookbinding unit, the control method comprising:

a determination step of determining whether a sheet is a type that is prohibited from performing the buffering process by the buffer unit; and a control step of adjusting an ejection order so that the sheet of the type that is prohibited from performing the buffering process is not ejected within the predetermined number of sheets from the first sheet of sheets that constitute the sheet bundle, when it is determines that the sheet is the type that is prohibited from performing the buffering process in said determination step.

6. A control method for an image forming system comprising:

an image forming step of forming an image onto a sheet;

a bookbinding step of binding a book by attaching a ring to a punch hole of a sheet bundle that consists of a plurality of sheets on which images are formed;

a buffering step of performing a buffering process to convey a predetermined number of sheets in piles so that sheets for a next sheet bundle are not ejected onto a sheet bundle that is being processed in said bookbinding step;

a determination step of determining whether a sheet is a type that is prohibited from performing the buffering process in said buffering step; and a control step of adjusting an ejection order so that the sheet of the type that is prohibited from performing the buffering process is not ejected within the predetermined number of sheets from the first sheet of sheets that constitute the sheet bundle, when it is determines that the sheet is the that is prohibited from performing the buffering process in said determination step.

* * * * *